US005717155A

United States Patent [19]

Szalay

[11] Patent Number: 5,717,155

[45] Date of Patent: Feb. 10, 1998

[54] SYNTHESIZER DETECTING PITCH AND PLUCKING POINT OF STRINGED INSTRUMENT TO GENERATE TONES

[75] Inventor: Andreas Szalay, Emmelshausen, Germany

[73] Assignee: Yamaha Corporation, Japan

[21] Appl. No.: 662,474

[22] Filed: Jun. 13, 1996

[30] Foreign Application Priority Data

Jun. 16, 1995 [JP] Japan ..... 7-173038

[51] Int. Cl.[6] ..... G10H 1/057; G10H 1/06; G10H 3/18

[52] U.S. Cl. ..... 84/723; 84/735; 84/738

[58] Field of Search ..... 84/646, 722–742, 84/DIG. 30

[56] References Cited

U.S. PATENT DOCUMENTS

| | | | |
|---|---|---|---|
| 4,151,775 | 5/1979 | Merriman . | |
| 4,723,468 | 2/1988 | Takabayashi et al. . | |
| 4,924,746 | 5/1990 | Obata . | |
| 5,001,960 | 3/1991 | Katou | 84/735 |
| 5,014,589 | 5/1991 | Obata | 84/735 |
| 5,138,924 | 8/1992 | Ohya et al. . | |
| 5,367,120 | 11/1994 | Hoshiai | 84/736 X |

FOREIGN PATENT DOCUMENTS

| | | |
|---|---|---|
| 0 142 935 | 5/1985 | European Pat. Off. . |
| 55-87196 | 7/1980 | Japan . |

*Primary Examiner*—Stanley J. Witkowski
*Attorney, Agent, or Firm*—Graham & James LLP

[57] ABSTRACT

In an electronic musical apparatus having an acoustic instrument manually operable to commence an acoustic vibration and a tone generator responsive to the acoustic vibration to generate a musical tone having a pitch corresponding to that of the acoustic vibration, a pitch detecting device utilizes a pickup for picking up the acoustic vibration to convert the same into a waveform signal. Further, a first detector operates according to a fast algorithm for processing the waveform signal so as responsively produce a first output representative of the pitch of the acoustic vibration, and a second detector operates in parallel to the first detector for processing the same waveform signal according to a slow algorithm so as to stably produce a second output representative of the pitch of the acoustic vibration. A selector selectively feeds one of the first output and the second output to the tone generator so that the first detector and the second detector can cooperate to ensure responsive and stable detection of the pitch. An additional detector processes the waveform signal to measure a time interval between a pair of the peaks so as to detect a plucking point. A controller controls the tone generator according to the detected plucking point to change the timbre of the tone generator.

39 Claims, 15 Drawing Sheets

GUITAR PITCH

MIDI PITCH

SYNTHESIZER DETECTING PITCH AND PLUCKING POINT OF STRINGED INSTRUMENT TO GENERATE TONES

BACKGROUND OF THE INVENTION

The present invention relates to a pitch detection technology in an electronic musical apparatus having an acoustic instrument manually operable to commence an acoustic vibration and a tone generator responsive to the acoustic vibration to generate a musical tone having a pitch corresponding to that of the acoustic vibration. The present invention relates also to a plucking point detection technology in an electronic musical apparatus having a stringed instrument manually operable at a variable plucking point to commence an acoustic vibration and a tone generator responsive to the acoustic vibration to generate a musical tone having a variable timbre depending on the variable plucking point.

In the prior art, there is known an electronic musical apparatus called guitar synthesizer or electric guitar, in which a pitch of the guitar is detected in order to drive a tone generator based on the detected pitch so that a tone is synthesized in response to manual performance of the guitar. In the guitar synthesizer, a vibration of a played string is detected by a pickup, and the detected vibration signal is fed to a pitch detector. The pitch detector detects the pitch of the input vibration signal by extracting therefrom a fundamental frequency component.

Generally in a stringed instrument such as the guitar, a timbre of the tone varies in response to a plucking point on the string. However, the conventional guitar synthesizer could not recognize the plucking point, namely a position at which the string is picked. Therefore, the synthesizer could not generate the tone having a timbre corresponding to the plucking point.

Further, the vibration signal from the string contains a lot of harmonics especially in an initial phase just after picking, so that the conventional pitch detector requires plural vibration periods just after the picking in order to extract the fundamental wave component to detect the pitch. Thus, it may cause delay in the actual tone generation.

Further, in the stringed instrument such as the guitar, the player often articulates multiple fingers simultaneously to hold multiple strings. In changing a chord on the instrument, the fingering position is sometimes changed so quickly that the actual fingered position of the string may move off the regular position at the fret. In this situation, the actual length of the string is deviated from the regular length. Thus, the vibration period is unintentionally changed so that the pitch detected by the pitch detector may be shifted as well. In order to compensate for such an erroneous shift, pitch quantization is executed in the prior art, wherein the shifted pitch is corrected to a regular pitch. However, in the stringed instrument such as the guitar, the player sometimes performs a choking method. The choking or bending is one of the playing techniques, in which the string is pushed up or pulled down to change the pitch. In the conventional implementation of the guitar synthesizer, a pitch-bend is imparted to the tone by the choking. However, if the quantization is executed after the pitch detection, the quantization affects the pitch-bend caused by the choking or bending. Thus, the pitch data outputted from the pitch detector changes unnaturally in a stepwise manner.

SUMMARY OF THE INVENTION

Therefore, the first purpose of the present invention is to provide a plucking point detection device and method by which the plucking point of the string is detected in order to control a timbre in response to the plucking point.

The second purpose of the present invention is to provide a pitch detection device and method by which accurate pitch data can be derived at a high speed.

Further, the third purpose of the present invention is to provide a pitch detection device and method by which the accurate pitch can be derived when the player performs unintentional or unconscious pitch-bend, while a natural pitch shift can be ensured when the player intentionally performs the pitch-bend.

According to a first aspect of the invention, in an electronic musical apparatus having a stringed instrument manually operable at a variable plucking point to commence an acoustic vibration and a tone generator responsive to the acoustic vibration to generate a musical tone having a variable timbre depending on the variable plucking point, a plucking point detecting device comprises pickup means for picking up the acoustic vibration to convert the same into a waveform signal which contains a pair of peaks distributed at a variable time interval depending on the plucking point, detector means for processing the waveform signal to measure the time interval between the pair of the peaks so as to detect the plucking point, and controller means for controlling the tone generator according to the detected plucking point to change the timbre of the tone generator in response to the plucking point.

According to a second aspect of the invention, in an electronic musical apparatus having an acoustic instrument manually operable to commence an acoustic vibration and a tone generator responsive to the acoustic vibration to generate a musical tone having a pitch corresponding to that of the acoustic vibration, a pitch detecting device comprises pickup means for picking up the acoustic vibration to convert the same into a waveform signal, first detector means operative according to a fast algorithm for processing the waveform signal so as to responsively produce a first output representative of the pitch of the acoustic vibration, second detector means operative in parallel to the first detector means for processing the same waveform signal according to a slow algorithm so as to stably produce a second output representative of the pitch of the acoustic vibration, and selector means for selectively feeding one of the first output and the second output to the tone generator so that the first detector means and the second detector means can cooperate complementarily with each other to ensure responsive and stable detection of the pitch of the acoustic vibration. Preferably, the first detector means comprises means for calculating a time interval between two peaks successively contained in the waveform signal according to the first algorithm so as to roughly detect the pitch, while the second detector means comprises means for calculating an average of time intervals among three or more peaks successively contained in the waveform signal according to the slow algorithm so as to finely detect the pitch.

Preferably, the selector means comprises means operative during an initial period immediately after the acoustic vibration is commenced for selecting the first, output, and being operative after the initial period has passed for selecting the second output. Preferably, the selector means comprises means for switching from the first output to the second output when the second detector means succeedingly becomes effective to produce the second output after the first detector means precedingly becomes effective to produce the first output. Preferably, the selector means comprises means operative when the first detector means fails to produce the first output for selecting the second output in place of the missing first output. Preferably, the first detector means includes a neural network for learning the processing of the waveform signal according to teaching information to improve detection of the pitch, and the selector means includes means operative when the first detector means does not operate well for providing the second output as the teaching information to the first detector means. Preferably, the pitch detecting device includes variation detector means connected to either of the first detector means and the secured detector means for detecting variation of the pitch of the acoustic vibration, quantizer means connected between the selector means and the tone generator and being operative when the detected variation falls within a predetermined range for quantizing the selected one of the first output and the second output to a fixed pitch so as to remove unintentional fluctuation of the acoustic vibration, and controller means operative when the detected variation falls out of the predetermined range for disabling the quantizer means to feed the selected one of the first output and the second output as it is to the tone generator to thereby reserve intentional deviation of the acoustic vibration. Preferably, the pitch detecting device includes quantizer means connected between the selector means and the tone generator for quantizing the selected one of the first output and the second output to fix the pitch of the musical tone so as to remove fluctuation of the acoustic vibration, and controller means operative during an initial period from the commencing of the acoustic vibration for suppressing the quantizer means to feed the selected one of the first output and the second output as it is to the tone generator so that the musical tone reserves an attack part of the acoustic vibration. Preferably, either of the first detector means and the second detector means includes means for detecting the pitch of the acoustic vibration commenced by plucking a stringed acoustic instrument at a variable plucking point, and means for detecting the plucking point according to the waveform signal so that a timbre of the musical tone can be controlled according to the detected plucking point.

According to a third aspect of the invention, in an electronic musical apparatus having an acoustic instrument manually operable to commence an acoustic vibration and a tone generator responsive to the acoustic vibration to generate a musical tone having a pitch corresponding to that of the acoustic vibration, a pitch detecting device comprises pickup means for picking up the acoustic vibration to convert the same into a waveform signal, detector means for processing the waveform signal to successively detect a pitch of the acoustic vibration, quantizer means for successively quantizing the detected pitch and feeding the quantized pitch to the tone generator so that the tone generator can generate the musical tone having the successively quantized pitch, and controller means operative depending on a specific condition of the acoustic vibration for temporarily disabling the quantizer means so as to feed detected pitch as it is to the tone generator so that the generated musical tone temporarily maintains the detected pitch which reflects the specific condition of the acoustic vibration. Preferably, the controller means comprises means for detecting variation of the successively detected pitch, and means operative when the detected variation falls within a predetermined range under a normal condition for enabling the quantizer means and being operative when the detected variation falls out, of the predetermined range under a specific condition for disabling the quantizer means. Preferably, the controller means comprises means operative during an initial period from the commencement of the acoustic vibration for disabling the quantizer means, and being operative after the initial period has passed for enabling the quantizer means.

In operation of the first aspect of the present invention, it is possible to detect the plucking point or playing position where the string is picked by measuring the interval between the peaks or intermittent vibration pulses propagated along the string. In operation of the second aspect of the present, invention, the first pitch detector means detects the pitch of the input waveform signal or vibration signal at high speed, and the second pitch detector means detects the pitch of the input vibration signal according to a pitch detection algorithm different from that of the first pitch detector means. These first and second pitch detector means can cooperate complementarily with each other. Thus the accurate pitch can be detected under variable situations. Further, in operation of the third aspect of the present invention, the quantizer means is controlled to stop the pitch quantization in case that the pitch bending is detected. Thus, if the player performs the string choking or bending, the pitch effected by the bending can be ensured as it is. Moreover, the accurate pitch can be derived even when the fingered position of the string is moved off the regular position.

DETAILED DESCRIPTION OF THE INVENTION

Figure 1:
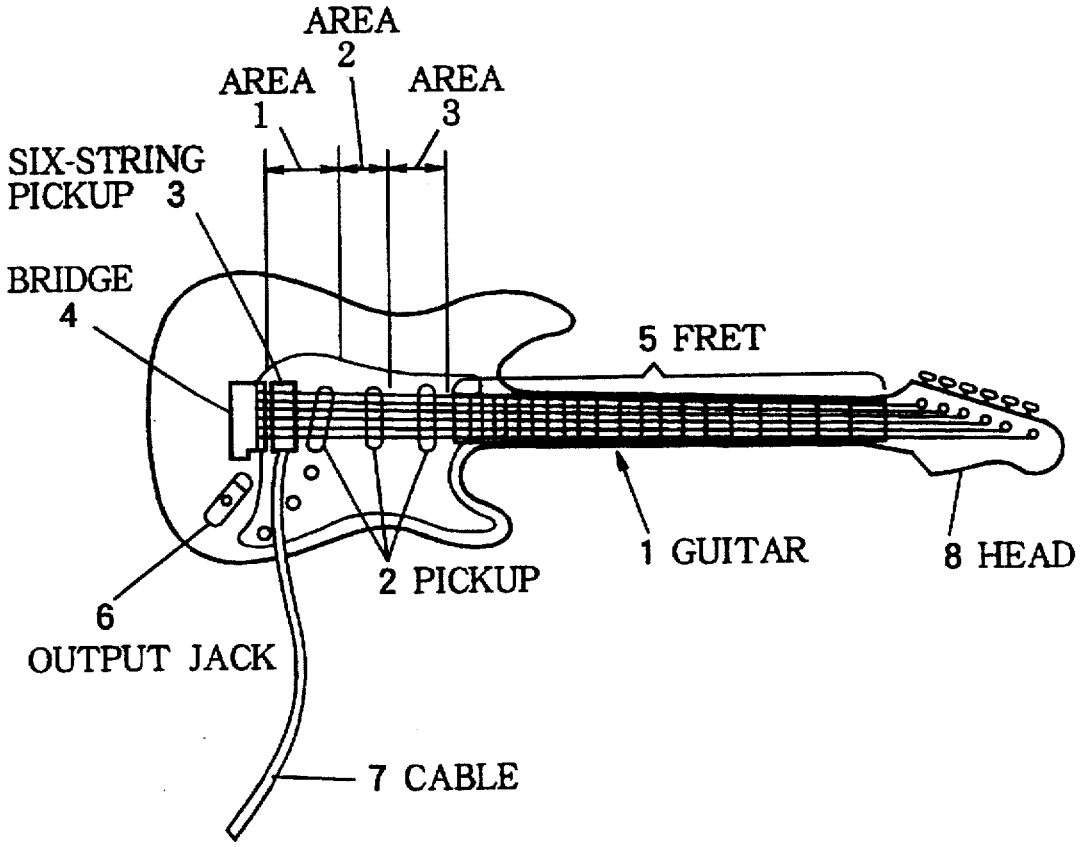
FIG. 1 shows an electric guitar provided with a six-string pickup.

The present invention relates to a pitch detection device for detecting a pitch from a vibration waveform, and a plucking point detection device for detecting a plucking point, in a stringed instrument such as guitar. In the description below, the guitar is referred to as an example, and the pitch detection device and the plucking point detection device for the guitar will be explained. In FIG. 1, a guitar 1 is an electric guitar, in which six steel strings are extended between a bridge 4 and a machine head 8. The guitar 1 is provided at three predetermined positions on the guitar body with three pickups 2, by which the vibration of the strings are picked up. The output of the pickups 2 is a composite signal containing vibrations from the six strings. The composite signal is fed out from an output jack 6. Separately from the pickup 2, for transmitting performance information from the guitar 1 to a guitar synthesizer (not shown), each vibration waveform of the six steel strings should be picked up independently so that a six-string pickup 3 is provided under the strings. This pickup 3 picks up respective vibration waveforms of the six strings independently from each other. The outputs of the pickup 3 are sent via a connector cable 7 to the guitar synthesizer, in which the pitch detection device for each vibration waveform and the plucking point detection device are provided according to the present invention.

Figure 3:
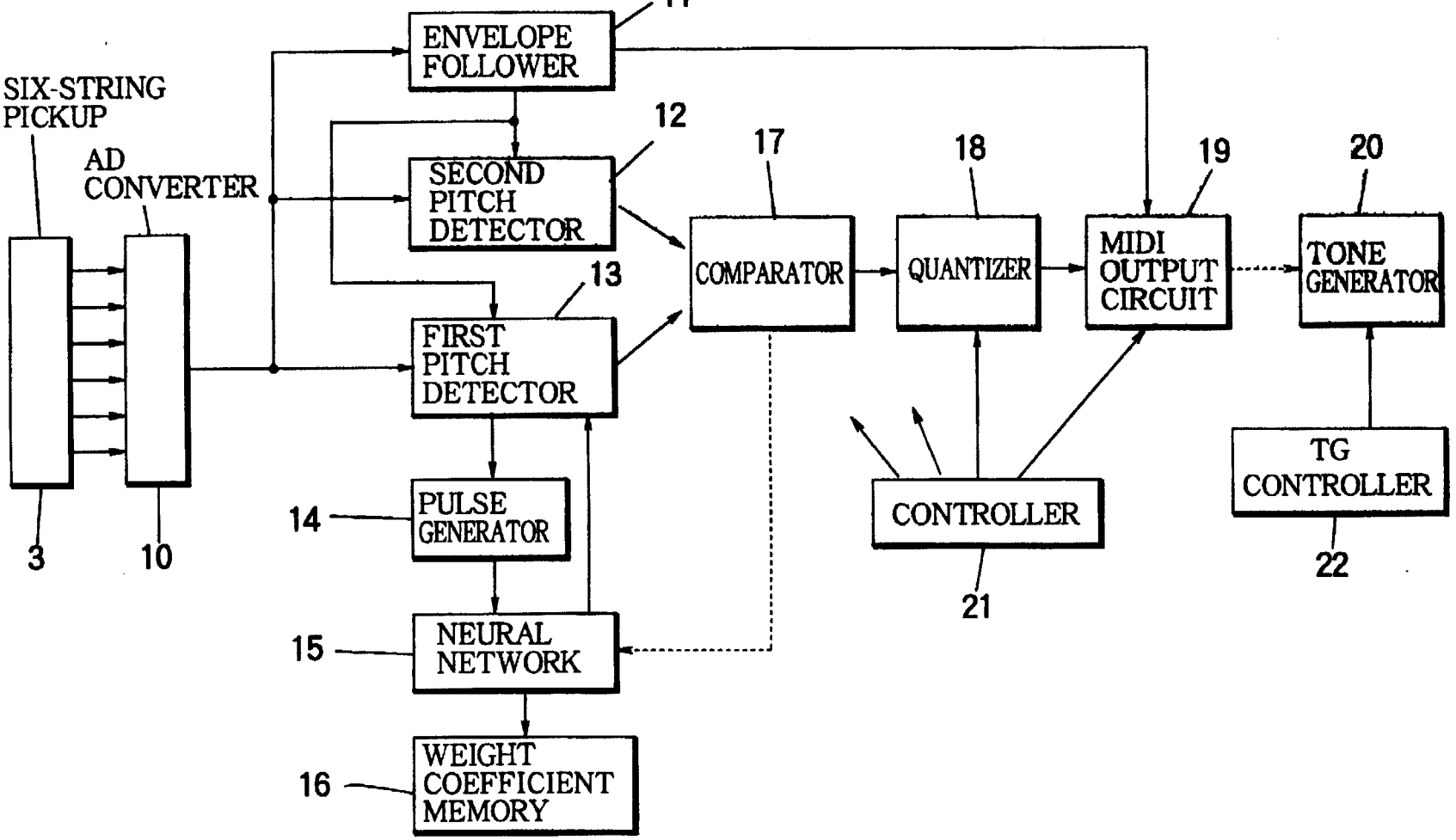
FIG. 3 is a schematic block diagram illustrating an arrangement in which a plucking position detection device and a pitch detection device are installed according to the present invention.

FIG. 3 is a schematic block diagram of detection blocks contained in the guitar synthesizer employing the pitch detection device and the plucking point detection device according to the present invention. In FIG. 3, the six-string pickup 3 disposed under the six strings picks up the respective vibration waveform signals of the six strings independently from each other. The picked up vibration waveform signals are distributed to an AD converter 10. The AD converter 10 converts the vibration waveform signals of the six strings into corresponding digital data by time-sharing processing. At every sampling timing, the converted digital data are outputted to those of an envelope follower 11, a first pitch detector 13, and a second pitch detector 12. The envelope follower 11 detects an envelope of each digitized waveform signal. Upon this detection of the envelope, a note-on or note-off event and a velocity are sensed. The results of the detection of the note-on or note-off event and the velocity are distributed to those of the first pitch detector 13, the second pitch detector 12, and a MIDI output circuit 19.

The second pitch detector 12 detects the pitch of the inputted waveform signal by sensing a zero-cross point according to a relatively slow algorithm. The first pitch detector 13 detects the pitch of the same waveform signal using a neural network 15. Interval time data or duration data between successive peaks contained in the waveform signal is detected by a pulse generator 14 and the detected duration data is distributed to the neural network 15, which multiplies the inputted duration data with weight coefficients read out from a weight coefficient memory 16 in order to calculate the pitch data and the playing position (plucking point) data corresponding to the performance of the guitar. The pitch data produced by the first and second pitch detectors 13, 12 are fed to a comparator 17. The comparator 17 selects one of the pitch data outputted from the detectors 12 and 13. The comparator 17 outputs earlier one of the pitch data, and distributes the selected pitch data to a quantizer 18.

The quantizer 18 distributes the inputted pitch data from the comparator 17 to the MIDI output circuit 19. The comparator 17 also outputs the plucking point data, and this data is distributed to the MIDI output circuit 19 as it is. The MIDI output circuit 19 is provided with information from a controller 21 to specify a MIDI message format used for transformation of the playing position data (the plucking point data). The information is set by operating switches, and the playing position data is converted into a MIDI message such as a program change, a control change or a parameter control in order to change a timbre. The MIDI output circuit 19 also converts events such as note-on, note-off, pitch-bend into a MIDI signal. The converted MIDI signal is distributed to an external tone generator (TG) 20. The controller 21 is connected to all blocks in addition to the MIDI output, device 19 (though not shown explicitly in the figure), and controls required setups in the blocks.

The tone generator 20 synthesizes and reproduces a musical tone according to the inputted MIDI signal. If the playing position data is sent in the form of a program change data, the tone generator 20 changes the timbre specified by an inputted timbre number contained in the program change data. If the playing position data is sent in the form of the parameter control data, timbre parameters are modified similarly. However, if the playing position data is sent in the form of the control change data, a timbre control parameter to be modified is not known so that assignment of the control change data to a particular timbre control parameter is determined by a TG controller 22.

In this arrangement, upon picking a string of the guitar 1 shown in FIG. 1, the vibration of the string is picked up by the six-string pickup 3, and the sensed waveform signal is sent to the AD converter 10. The digital sampling data of the waveform signal converted by the AD converter 10 is distributed to the envelope follower 11. The envelope of the digitized waveform signal is detected by the envelope follower 11 so that beginning of a tone (note-on) by the picking, ending of the tone (note-off) on ceasing of the string vibration, and velocity data (volume) of the tone are sensed. The sensed results are distributed to those of the MIDI output circuit 19 and the first and second pitch detectors 13 and 12. In response thereto, the first pitch detector 13 generates pitch data at high speed using the neural network 15, and also generates the playing (plucking) position data.

Figure 2:
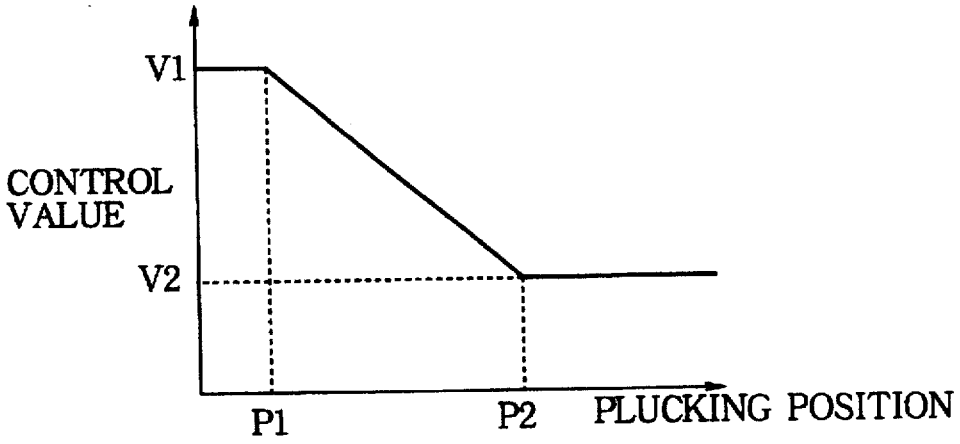
FIG. 2 shows a characteristic curve of a control value in response to a plucking point of the guitar.

The playing (plucking) position is detected because the timbre of the guitar varies in response to the plucking position. For example, in FIG. 1, the timbre of the instrument is different in picking areas 1, 2 or 3. Thus, in the present, embodiment, the timbre is changed in response to the picking areas (playing position). The timbre can be controlled delicately to simulate a natural guitar. Otherwise, the timbre may be changed drastically according to the picking areas. The timbre control can be accomplished by changing a control value according to the plucking position as shown in FIG. 2. For example, it is possible to allocate control values V1 and V2 respectively to plucking positions P1 and P2. The control value can be varied linearly between these two values V1 and V2 according to the plucking position. Depending on the control value, a cutoff frequency of the timbre filter can be modified to control the timbre. The linear variation of the control value shown in FIG. 2 can be replaced by a nonlinear variation.

Referring back to FIG. 3, the comparator 17 receives the first pitch data and the plucking position data generated by the first pitch detector 13 as well as the second pitch data generated by the second pitch detector 12. Normally, the first pitch detector 13 generates the first pitch data and the plucking position data faster than the second pitch data. The first pitch data from the first pitch detector 13 normally enters the comparator 17 earlier than the second pitch data. According to the order of the data arrival to the comparator 17, the first pitch data and the plucking position data are distributed to the quantizer 18. Then, the first pitch data is quantized by the quantizer 18. The plucking position data and the quantized first pitch data are fed to the MIDI output circuit 19. A note-on event in response to the first pitch data, a pitch-bend if any, and the plucking position data are converted into the MIDI data format specified by the controller 21. The MIDI data is transmitted to the tone generator 20. The tone generator 20 generates a musical tone by synthesis according to the received MIDI data. The pitch of the tone corresponds to the first pitch data, while the timbre of the tone corresponds to the plucking position data.

On the other hand, if the first pitch detector 13 fails to detect the pitch, the comparator 17 sends the second pitch data detected by the second pitch detector 12 in place of the first pitch data. After that, the same operation is carried out as described above. In this case, the comparator 17 commands the neural network 15 to learn the pitch detecting process so that the first pitch detector can output the same result as the second pitch data derived by the second pitch detector 12. The comparator 17 switches the output selection so that the first pitch detector 13 effectively detects the pitch only in an early phase, and then the second pitch data detected by the second pitch detector is utilized.

Figures 4A, 4B, 4C, 5:
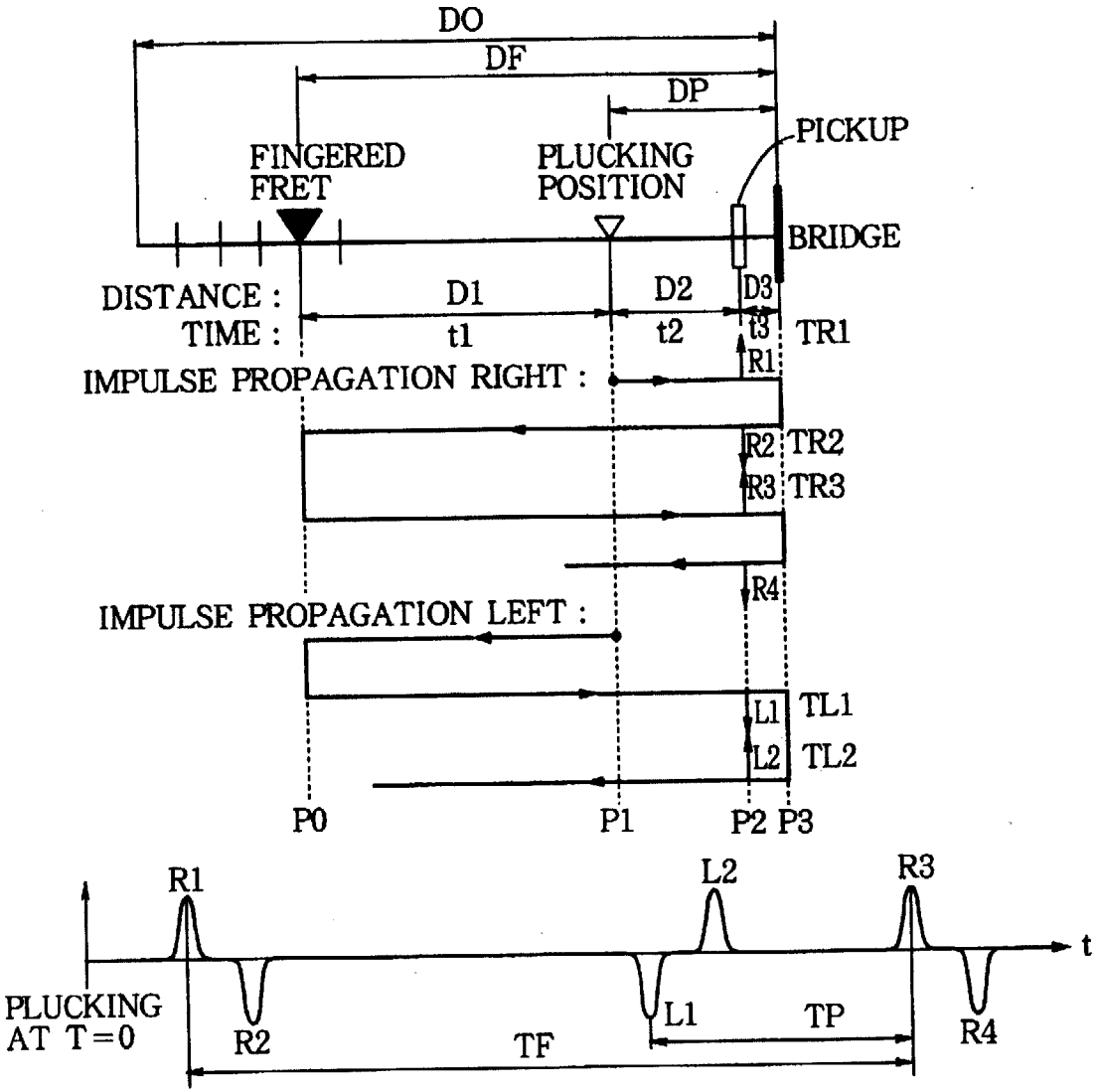
FIGS. 4A, 4B and 4C illustrate the principle of the plucking position detection and the pitch detection according to the present invention.
FIG. 5 illustrates vibration pulses propagated along a guitar string on time axis.

The principle of the plucking position detection and the pitch detection executed by the first pitch detector will be described with reference to FIGS. 4A–4C. FIG. 4A illustrates an acoustic model of the guitar, wherein BRIDGE corresponds to the bridge 4 shown in FIG. 1, PICKUP corresponds to the six-string pickup 3 and FRET corresponds to each fret 5. FINGERED FRET designates one fret 5 on which the player's finger is placed. PLUCKING POSITION denotes the playing position where the string is picked. The string length between FINGERED FRET and PLUCKING POSITION is assumed D1. The vibration propagates therebetween in a time t1. The string length between PLUCKING POSITION and PICKUP is denoted by D2, and the vibration transmission time therebetween is denoted by t2. The string length between BRIDGE and PICKUP is assumed to be D3, and the vibration transmission time therebetween is represented by t3. The open length of the string is denoted by D0, the string length between BRIDGE and FINGERED FRET is denoted by DF, and the string length between BRIDGE and PLUCKING POSITION is denoted by DP.

Now, the string is picked at PLUCKING POSITION, a pulsive vibration wave is produced at PLUCKING POSITION and is transmitted in opposite directions. The rightward transmission of the vibration pulse is shown in FIG. 4B, and the leftward transmission is shown in FIG. 4C. The rightward wave reaches PICKUP at time TR1 (=t2). At this time of TR1, the PICKUP detects a positive pulse or peak R1 as illustrated on the time axis t in FIG. 5. The pulse passed over PICKUP location is reflected at BRIDGE with phase inversion. Then, the pulse travels leftward and reaches PICKUP again at time TR2. The time TR2 can be described as follows:

$$TR2=t2+t3+t3=t2+2\times t3$$

The reflected and returning pulse is detected at the time TR2, which is illustrated as a negative pulse R2 on the time axis t in FIG. 5. The pulse is propagated further leftward, and is reflected at FINGERED FRET with phase inversion to thereby return rightward. At time TR3, the pulse reaches PICKUP for the third time. The time TR3 can be described as follows:

$$TR3=t2+t3+t3+t2+t1+t1+t2=2\times t1+3\times t2+2\times t3$$

The pulse is detected by PICKUP at time TR3, which is illustrated as a positive pulse R3 on the time axis t in FIG. 5. The pulse is transmitted between BRIDGE and FINGERED FRET repeatedly along the string in such a manner.

Another pulse or peak going leftward is reflected at FINGERED FRET with phase inversion, and then goes rightward as shown in FIG. 4C. The pulse reaches PICKUP at time TL1. The time TL1 can be described as follows:

$$TL1=t1+t1+t2=2\times t1+t2$$

The pulse is detected by PICKUP at time TL1, which is illustrated as a negative pulse L1 on the time axis t in FIG. 5. Then the pulse is reflected at BRIDGE with phase inversion, and goes leftward to reach PICKUP again at time TL2. The time TL2 can be described as follows:

$$TL2=t1+t1+t2+t3+t3=2\times t1+t2+2\times t3$$

The pulse is detected at time TL2, which is illustrated as a positive pulse L2 on the time axis t in FIG. 5. Thereafter, the pulse is transmitted between BRIDGE and FINGERED FRET repeatedly along the string.

The pitch, namely the frequency of the vibration of the string, is determined by the length DF between BRIDGE and FINGERED FRET. It is understood, with reference to FIG. 5, that the time interval or period TF between the pulse or peak R1 detected by PICKUP and the next pulse or peak R3 corresponds to the time required for the pulse to propagate the distance 2×DF. Thus, the time interval TF corresponds to a period of the vibration generated in the string. The period of the vibration can be defined as:

$$TF=TR3-TR1$$

By introducing the transmission times TR1 and TR3 as calculated before into the above relation, the period TF is calculated as follows:

$$TF=(2\times t1+3\times t2+2\times t3)-t2=2\times(t1+t2+t3)$$

The pitch F can be described as follows:

$$F=\frac{1}{TF}$$

By detecting the travelling time of the pulse occurring at the first period, the pitch of the note can be detected at high speed. The same result is obtained even by detecting the pulse occurring at the second or later period.

Now the method or algorithm for detecting the position P1 denoted by the PLUCKING POSITION will be explained hereunder. The velocity v of the vibration in the string is represented as follows:

$$v=\frac{2\times D0}{T0}$$

where T0 denotes a period of the open string vibration.

The lengths D2 and D3 are described as follows:

$$D2=v\times t2$$

$$D3=v\times t3$$

The distance DP between PLUCKING POSITION and BRIDGE is represented as follows:

$$DP=D2+D3=v\times(t2+t3)$$

By substituting v with the equation above, DP can be described as follows:

$$DP=v\times(t2+t3)=2\times(t2+t3)\times v\frac{D0}{T0}$$

Considering the pulses L1 and R3 in FIG. 5, the time interval TP therebetween can be derived as follows:

$$\begin{aligned} TP &= TR3-TL1 \\ &= (2\times t1+3\times t2+2\times t3)-(2\times t1+t2) \\ &= 2\times(t2+t3) \end{aligned}$$

Substituting the equation of DP above with this equation, DP is calculated as follows:

$$DP=TP\times D0/T0$$

Since the open string length D0 and the period of the open string vibration T0 are known by measurement in advance, the distance DP between PLUCKING POSITION and BRIDGE can be derived by detecting the time interval TP.

Figure 6A:
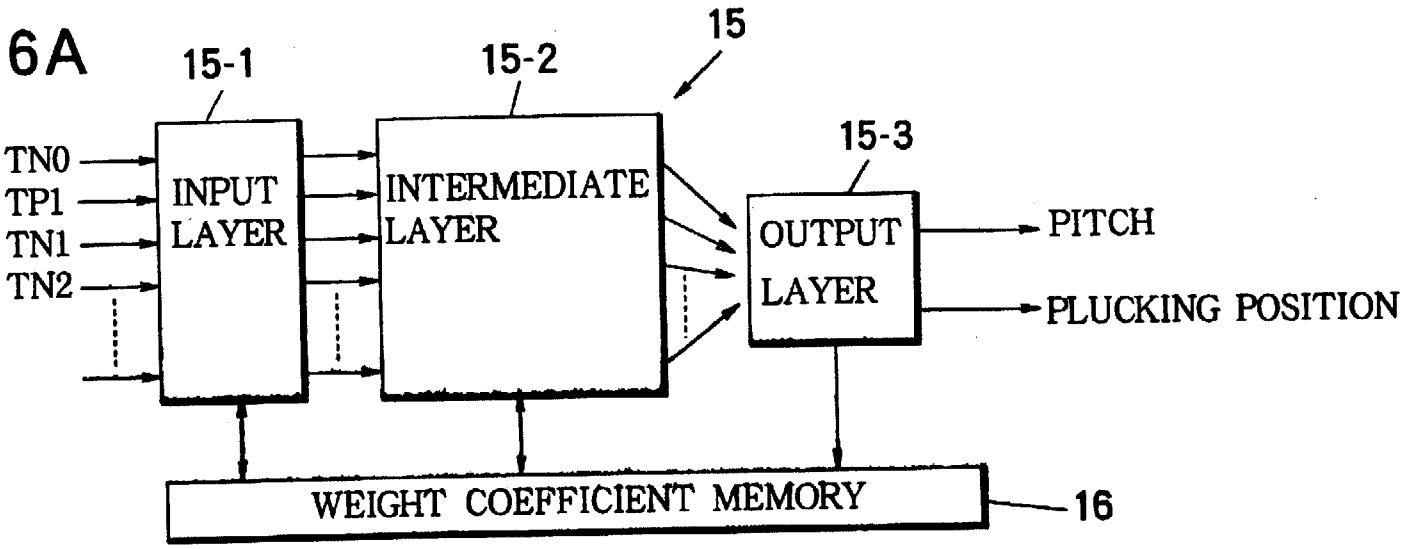
FIGS. 6A and 6B show structure of a neural network used in the pitch detection of the first pitch detector, and an actually detected waveform of the pulses transmitted along the string.
Figure 6B:
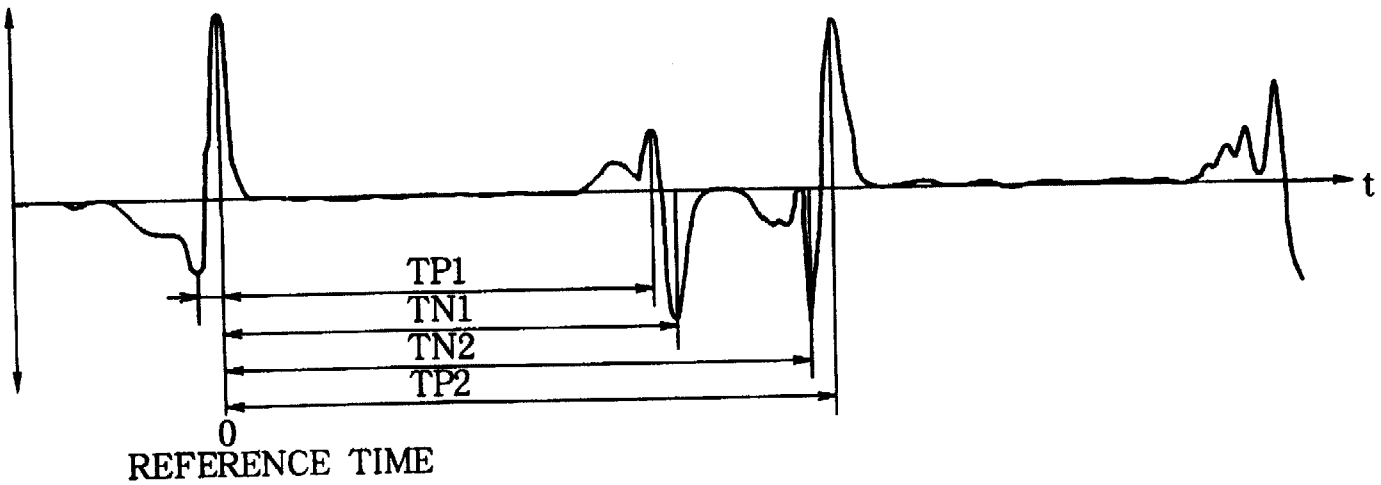

As described above, it is possible to detect the pitch of the vibration developed in the string and the playing position of the picking string. Such a detection is accomplished by the first pitch detector. Its detailed structure and a waveform actually detected are illustrated in FIGS. 6A and 6B. FIG. 6A illustrates a model of the neural network 15, which is comprised of at least three layers including an input layer 15-1, an intermediate layer 15-2 and an output layer 15-3, and further a weight coefficient memory 16. The neural network 15 learns in advance to generate pitch data based on input waveform data. The learning result is stored in the weight coefficient memory 16. In the pitch detection, each of the pulse peak timing data TN0, TP1, TN1, TN2 . . . measured from a reference time shown in FIG. 6B is inputted to the input layer 15-1. The input layer 15-1 multiplies the inputted data by weight coefficients read out from the weight coefficient memory 16. Then, the intermediate layer 15-2 multiplies the outputted data from the input layer 15-1 by weight coefficients read out from the weight coefficient memory 16. Further, the output layer 15-3 multiplies the outputted data from the intermediate layer 15-2 by weight coefficients read out from the weight coefficient memory 16. Thus, the detection reliability is ensured, and only the reliable pitch data and the PLUCKING POSITION data arc outputted. The neural network 15 may not be fed with the tinting data of the peaks of the pulse, but may be fed with area data of the pulse or peak level data. The reference time in FIG. 6B is set to the peak timing of the first detected pulse. However, the reference time may be determined in terms of a center of gravity of the pulse, or a timing when the pulse crosses a certain threshold level.

Figure 7A:
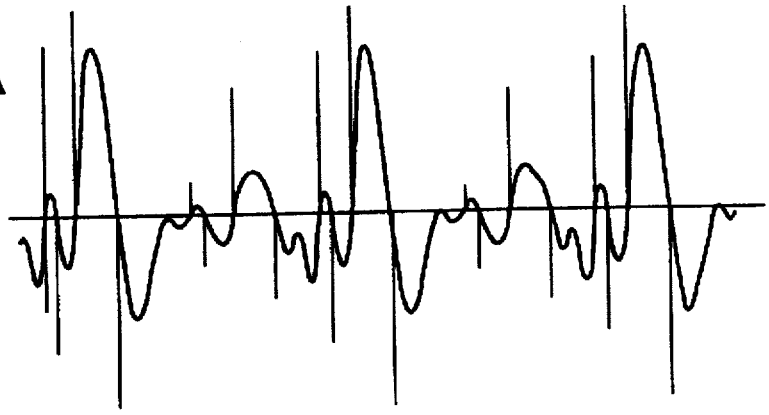
FIGS. 7A–7F illustrate a pitch detection algorithm executed by the second pitch detector.
Figure 7B:
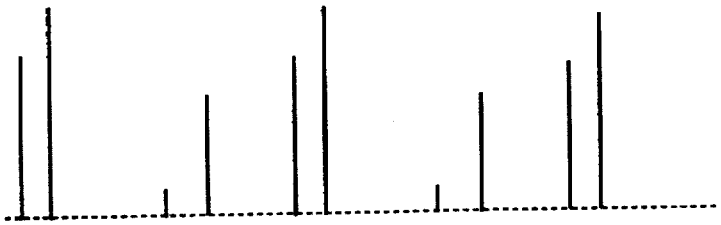
Figure 7C:
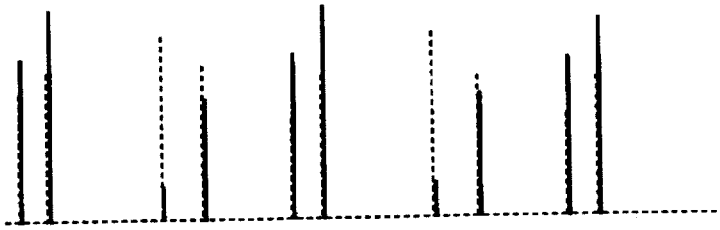
Figure 7D:
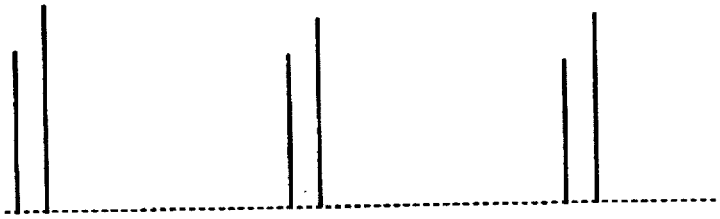
Figure 7E:
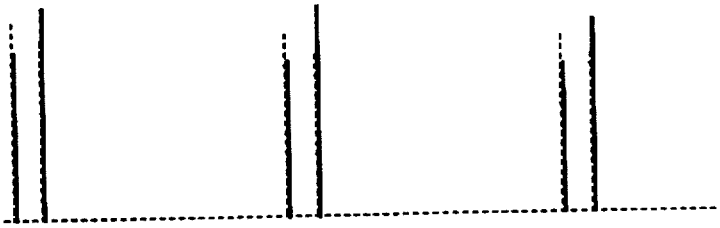
Figure 7F:
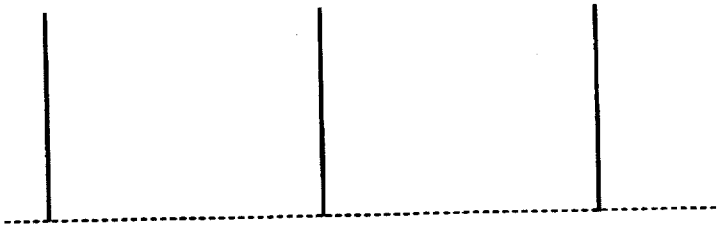

The pitch detection method or algorithm by the second pitch detector 12 will be described hereunder with reference to FIGS. 7A–7F. The second pitch detector 12 detects the pitch by sensing a zero-cross point of the vibration waveform signal. A periodic curve shown in FIG. 7A is a vibration wave of the string detected by the six-string pickup 3. Each straight line segment vertical to the time axis indicates steepness of each peak. Namely, a length of the line segment indicates an angle by which the vibration wave crosses the time axis. Particularly, the steepness of the vibration wave at zero-cross points are detected, and the length of the vertical line segments varies according to the detected steepness. The pitch is detected based on the steepness, wherein only the positive steepness data D of each rising slope is extracted as shown in FIG. 7B. Then, the steepness data D which can be used in the pitch detection is processed to extract significant ones. In the extraction process, an envelope data ENV1 is multiplied by a constant coefficient F1 to derive reference envelope data (ENVI×F1). The steepness data D is compared with the reference envelope data (ENV1×F1). This comparison is illustrated in FIG. 7C, wherein the steepness data D is shown in solid lines while the reference envelope data (ENV1×F1) is shown in dashed lines. With the comparison of the steepness data D and the reference envelope data (ENV1×F1), the data of a greater level is left as being valid. If the reference envelope data (ENV1×F1) is greater than the steepness data D, the relevant steepness data D is deleted, and the reference envelope data (ENV1×F1) is defined as a new envelope data ENV1. Then, the steepness data left as being valid is multiplied with the coefficient F1 to derive a new reference envelope data (ENV1×F1) to be used for next comparison with next steepness data D. Thereafter, the same comparison procedure is repeated. The valid steepness data D is extracted as shown in FIG. 7D. As illustrated in FIG. 7D, four of the steepness data D having smaller values are deleted. However, in this stage, the pitch cannot be detected from the left steepness data D. Further extraction procedure for the left steepness data D is continued. The further extraction process is similar to the previous extraction procedure as described above, except that reference envelope data (ENV2×F2) (multiplied with a coefficient F2) is used here. The reference envelope data (ENV2×F2) is illustrated in dashed lines adjacent to corresponding ones of the steepness data D shown in solid lines. With the comparison of the steepness data D and the reference envelope data (ENV2×F2) as shown in FIG. 7E, unwanted steeliness data D are further deleted so that the final steepness data D are derived as shown in FIG. 7F. The pitch of the tone can be detected accurately by measuring the duration between a pair of the final steepness data D shown in FIG. 7F. The detected pitch data is distributed to the comparator 17.

Figure 8A:
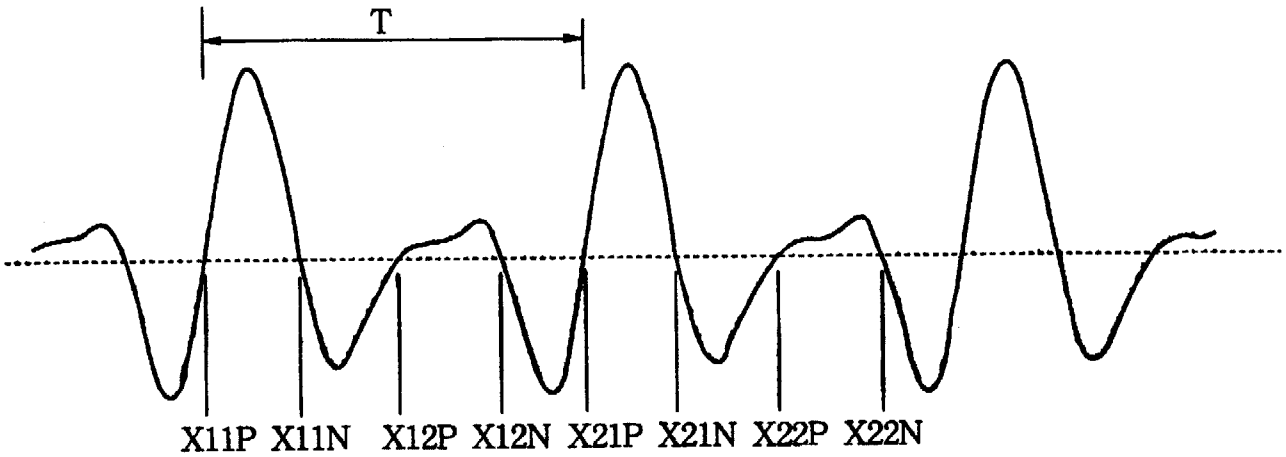
FIGS. 8A and 8B illustrate a zero-cross detection method executed by the second pitch detector.
Figure 8B:
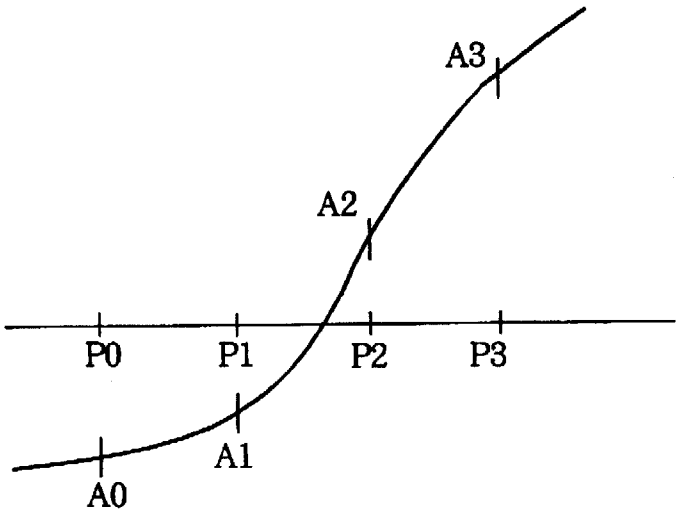

By the way, in detecting zero-cross points X11P, X11N, X12P, X12N . . . as shown in FIG. 8A, the input data is digitized as sampling data A0, A1, A2, A3 . . . at sampling timings P0, P1, P2, P3 . . . as shown in FIG. 8B. In other words, the zero-cross timings and the sampling data timings may not coincide with each other. Therefore, the zero-cross points are determined using interpolation. In the present invention, the steepness of the waveform signal at zero-cross is evaluated so that the zero-cross points should be measured accurately. Thus, if a zero-cross point is located between the sampling data A1 and A2 as shown in FIG. 8B, a differential data between the sampling data A1 and A0 and another differential data between the sampling data A3 and A2 are calculated. The two differential data are respectively located at positive and negative sides of the reference line (0 level). Therefore, the accurate zero-cross timing and the steepness data can be derived by interpolating an intermediate portion of the signal curve according to the pair of the differential data.

Figure 9:
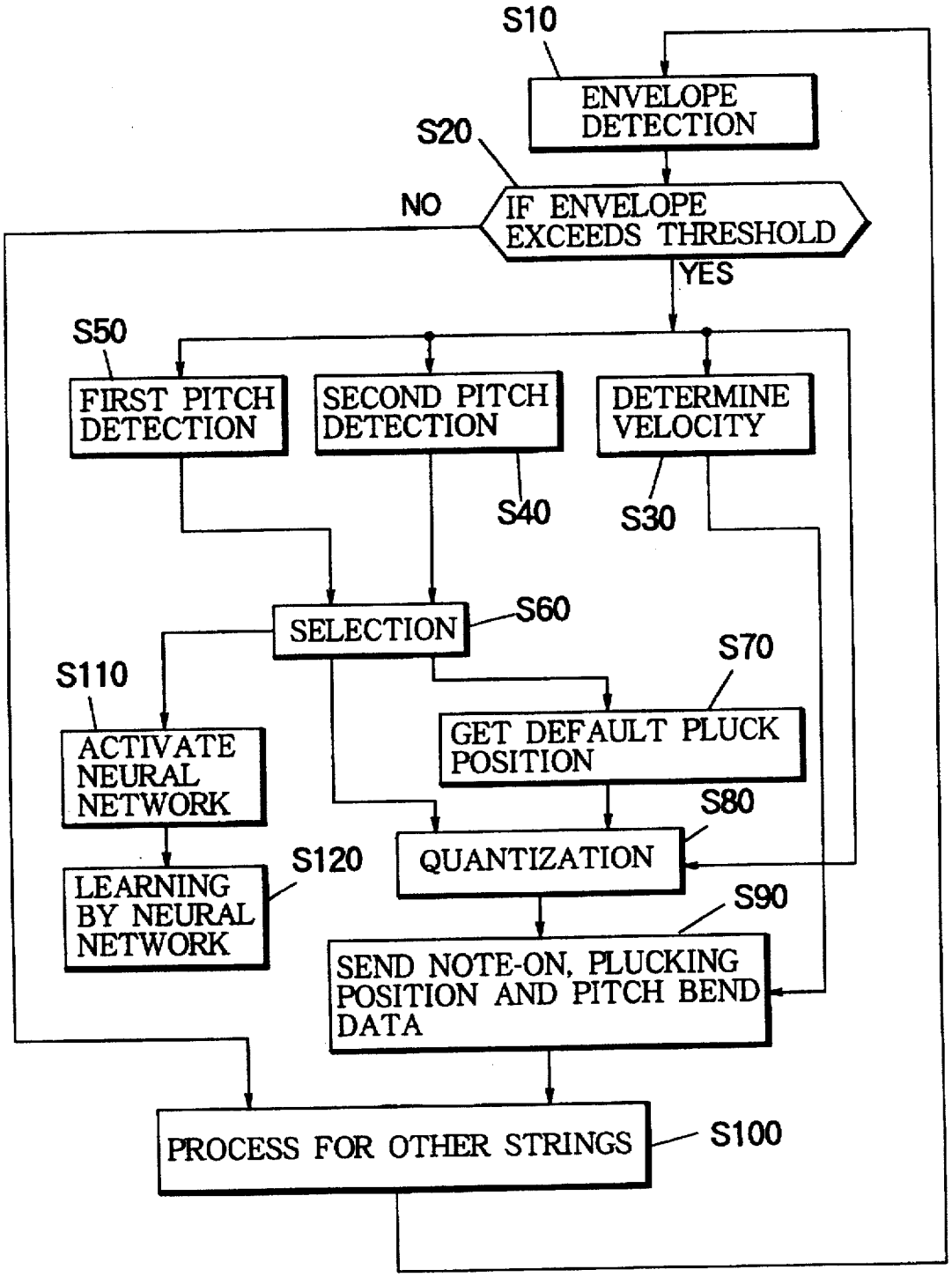
FIG. 9 is a flowchart illustrating signal processing according to the present invention.

The signal processing executed in the arrangement shown in FIG. 3 is illustrated in FIG. 9. The process is comprised of several subprocesses, and the subprocesses are executed repeatedly in loop. First of all, the operation of the envelope follower 11 will be described hereunder. The envelope follower 11 executes the process of steps S10 to S30. The envelope of the vibration waveform signal is picked up in step S10. Then, in step S20, it is tested whether the detected envelope level is greater than a threshold level or not. If the string of the guitar is picked to issue a note-on event, the envelope exceeds the threshold level so that the test result shows "yes". Then, the velocity is determined from the detected envelope. If there is no note-on event or the vibration of the picked string is ceased, the test in step S20 results in "no", so that the procedure branches to step S100, where the same procedure is executed for a next string. The processing shown in FIG. 9 is repeated for the six strings one by one.

If the result of the test in step S20 is "yes", the first pitch detection processing in step S50 and the second pitch detection processing in step S40 are started, so that the three processings in steps S30, S40, and S50 are executed in parallel. The operations of the first and the second pitch detectors 13 and 12 are executed respectively in the first and the second pitch detection processings in steps S50 and S40. These detection processings respectively produce their output results. In step S60, it is tested which of the first and second pitch detection processings outputs the pitch data faster than the other. If the first pitch detection process in step S50 outputs the pitch data faster, the selected first pitch detection data and the plucking position data are sent to the quantization process in step S80. The selection of the pitch data in step S60 is executed by the comparator 17 shown in FIG. 3. If the first pitch detection process in step S50 fails to detect the first pitch data, the failure is noticed to the comparator 17 in step S60. Upon the failure, the second pitch data from the second pitch detection process is selected in place of the first pitch data. The selected second pitch data is sent to the quantization process in step S80 together with default plucking position data derived in step S70. Since the first pitch detection process is executed by the neural network, the pitch can be detected at high speed even at the initial period of the vibration wave after the note-on event. On the other hand, the second pitch detection process accurately detects the pitch by extracting the zero-cross points of the fundamental pitch. Therefore, the detection accuracy is not so good as the first pitch detection process especially in an initial term just after the note-on event, but after that term, the detection accuracy becomes better than that of the first pitch detection. For this reason, in the comparison in step S60, it is possible to output the first pitch data detected by the first pitch detection process in the initial duration just after the note-on event, and thereafter the second pitch data from the second pitch detection process is selected in order to provide accurate pitch information at high speed. Otherwise, it is possible to substitute the first pitch data from the first pitch detection process with the second pitch data from the second pitch detection process as soon as the second pitch detection process starts to output the pitch data.

In the quantization process in step S80, the pitch data is quantized to derive regulated pitch data even when the string is picked with offset fingering position. However, the quantization is not executed in case that a pitch-bend event is recognized to be performed on the guitar. Further, the quantization is not executed in an initial duration just after the note-on event information is delivered to the quantizer. After the quantization, the MIDI data for synthesizing musical tone is generated in step S90, wherein the quantized pitch data, the plucking position data and the velocity data determined in step S30 are organized into the MIDI data based on the instruction from the controller 21 which specifies a MIDI data format into which the plucking position data should be converted.

If the first pitch detection in step S50 fails to produce an output, the procedure branches from step S60 to step S110 in order to teach the neural network. A learning controller instructs the neural network 15 to execute learning. The actual learning is done in step S120. The learning is executed by a back-propagation method using the pitch data generated by the second pitch detecting process. Thus, the pitch can be detected by the first pitch detection process when a next similar data is inputted. After these processes are done, the procedure goes forward to step S100, where the similar process is executed for the remaining strings.

Figure 10:
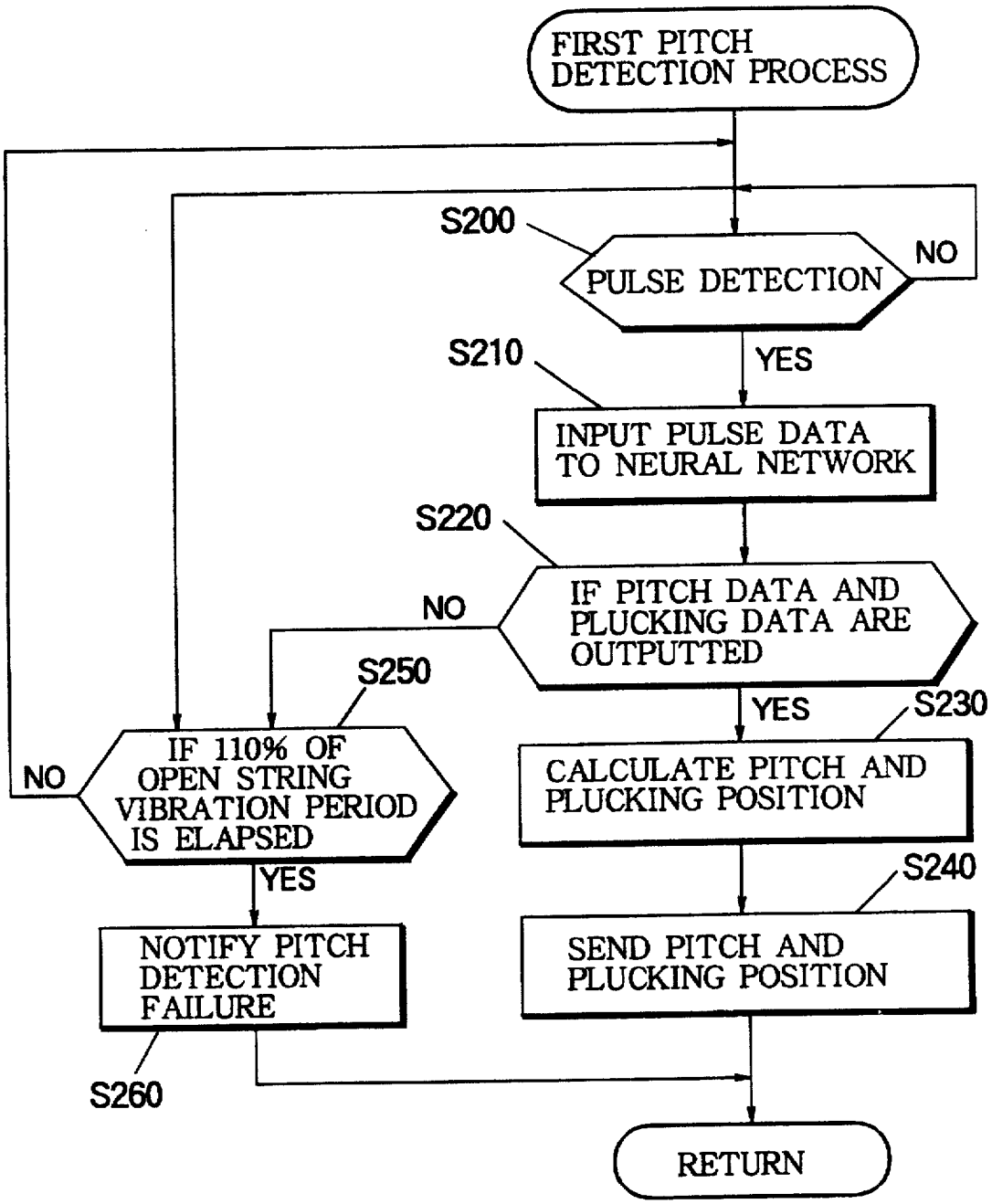
FIG. 10 is a flowchart illustrating the first pitch detection process according to the present invention.

The first pitch detection process is shown in FIG. 10. The data processing as shown in FIG. 6B is executed in this procedure. In step S200, a pulse or peak is detected from the input vibration wave signal. When the pulse is detected, this step S200 results in "yes" to thereby branch to step S210, wherein the peak timings of the successively detected pulses are inputted to the neural network 15 as shown in FIG. 6B. In step S220, it is tested whether both of flags respectively indicating the pitch data output and the plucking position data output are turned to "1". If "yes", the procedure proceeds to step S230. In step S230, the pitch and the plucking position are actually calculated. Then, in step S240, the calculated pitch and plucking position data are delivered to the comparison process in step S60.

The pulse detection in step S200 is repeated until a pulse is actually detected. Upon "no" judgement in step S220, the procedure branches to S250, in which it is tested whether a 110% time length of the open string vibration period is elapsed from the beginning of the step S200. This test is done with watching an output of a timer, which is reset at the beginning of the first pitch detection process. If the time is elapsed in step S250, the failure of the first pitch detection is noticed in step S260 to the comparison process of step S60, because the first pitch detection process should detect a pitch in the first period of the vibration. The detection time never exceeds the vibration period of the open string, hence it can be concluded that the pitch detection by the first pitch detector has failed if the 110%, time length of the open string vibration period is elapsed. If the 110%, time interval is not yet elapsed, the procedure returns to step S200 for the next pulse detection and the timer is reset. After the first pitch detection processing described above is finished, the comparison in step S60 is launched.

Figure 11:
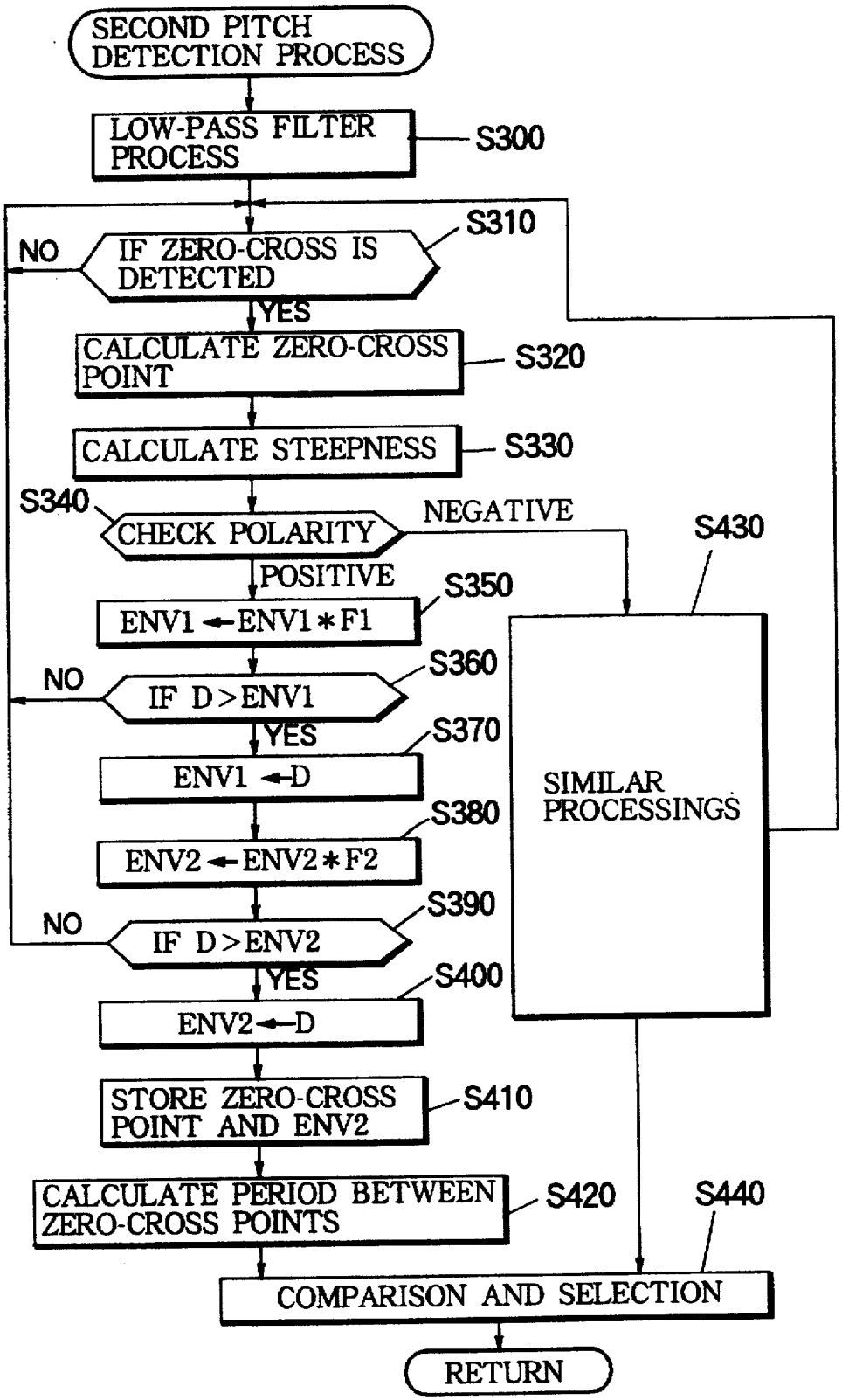
FIG. 11 is a flowchart illustrating the second pitch detection process according to the present invention.

The second pitch detection process is shown in a flowchart of FIG. 11. Upon commencing the second pitch detection, unnecessary frequency components are eliminated by applying low-pass filtering process to the input vibration signal in step S300. Then, a zero-cross of the input vibration signal is detected in step S310. If the zero-cross is detected, the interpolating process illustrated in FIG. 8B is conducted in step S320 in order to determine the accurate zero-cross point. Further in step S330, the steepness data is calculated in terms of the angle by which the vibration waveform crosses the time axis in step S330. In step S340, the polarity of the calculated steepness data is tested. If the steepness data is positive, the coefficient F1 is multiplied with the envelope data ENV1 to derive new envelope data ENV1 in step S350. Further in step S360, it is tested whether the value of the steepness data D exceeds the calculated envelope data ENV1 or not. If the result of this test is "yes", the steepness data D is set to a new envelope data ENV1 in step S370 for use in a next loop. If the value of the steepness data D does not exceed the envelope data ENV1 ("no" result in step S360), the procedure returns to step S310, where the steepness data D at the next zero-cross is calculated, and the steepness data D will be compared again with the envelope data ENV1 in step S360. These processings are shown in FIGS. 7B, 7C and 7D. After the process in step S370 is completed, a new envelope data ENV2 is calculated by multiplying the coefficient F2 with old ENV2 in step S380. Then, in step S390, it is tested whether the value of the steepness data D exceeds the calculated envelope data ENV2 or not. If the result of this test is "yes", the steepness data D is set to a new envelope data ENV2 in step S400 for use in the next loop. In step S410, the detected zero-cross point and the envelope data ENV2 are stored in a memory. In this case, the envelope data ENV2 is equivalent to the steepness data D. This process is shown in FIGS. 7E and 7F. Then, in step S420, when two or more of the data are stored, the pitch is calculated and outputted by measuring the intermediate interval between the zero-cross points. If the stored zero-cross points are just two, it means that the pitch is detected in one period of the string vibration. The detection reliability is low in the initial phase of the detecting process, hence it is desirable to postpone the output in order to achieve more accurate data process such as average calculation.

If the value of the steepness data D does not exceed the envelope data ENV2 ("no" result in step S390), the procedure returns to step S310, where the steepness data D at the next zero-cross is processed as described before with reference to FIGS. 7B, 7C and 7D. Then, steps S380 to S400 are executed all over again. If the steepness data D is detected as being negative, the processing similar to that in steps S350 to S420 is executed in step S430, and the detected pitch data is outputted. Thus, the pitch data derived from the positive and negative steepness data D are compared in step S440, and the pitch data corresponding to the greater steepness data is selected for the final output. Thus, the accurate pitch data can be detected by the second pitch detector.

Figure 12:
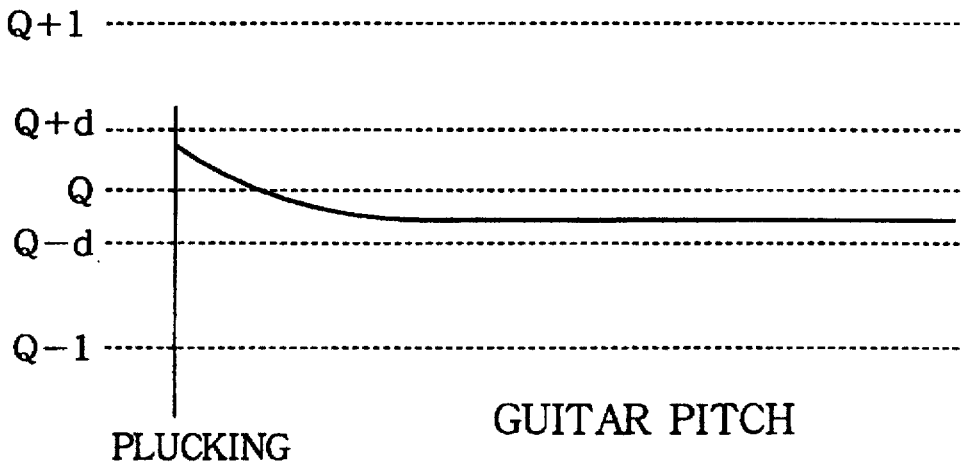
FIG. 12 illustrates a pitch shift derived from the vibration signal detected from the guitar.

The quantization process in step S80 will be explained in detail hereunder. The pitch shift, or pitch transition after picking of a string of the guitar is shown in FIG. 12. As illustrated in this figure, the pitch falls gradually after the plucking at a note-on event, and finally the pitch becomes stable at a certain level. A level Q in the figure denotes a regular pitch, and Q+1 and Q−1 respectively denote half step (semitone) higher and lower pitches. In the actual performance, especially in performing chord change, the finger may move off in the direction perpendicular to the string. In this situation, the pitch in stable phase offsets from Q as shown in FIG. 12. Thus, a range Q±d including the pitch Q as the central level is quantized to the normal value Q. This sort of the process is called the quantization.

Figure 14:
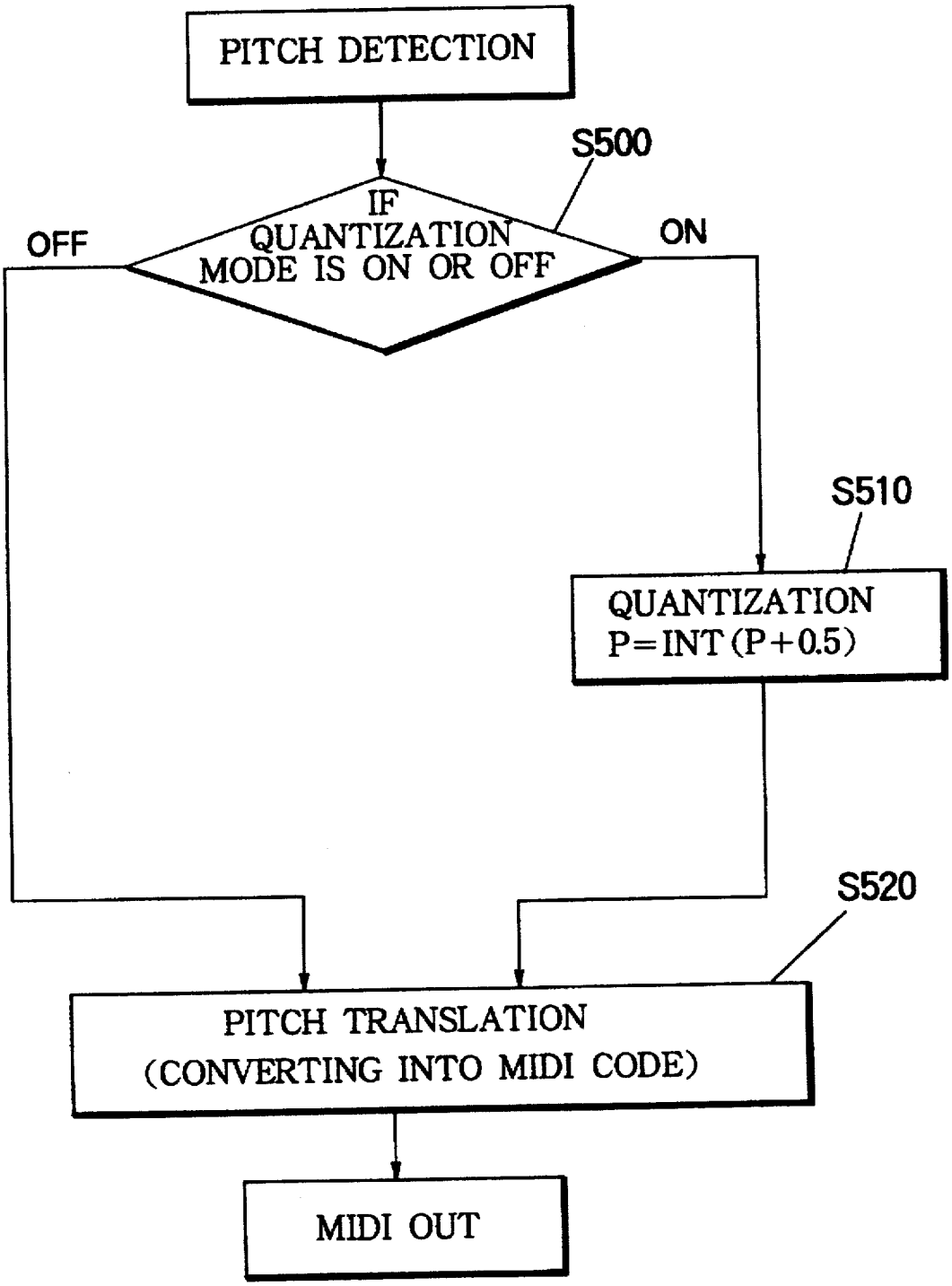
FIGURE 14 PRIOR ART
FIG. 14 is a flowchart illustrating the conventional quantization process.

The conventional pitch quantization is illustrated in FIG. 14, wherein the pitch detector outputs the pitch data, and the quantization mode is tested if it is "on" or "off" in step S500. The quantization mode can be set according to the user's intention. If the user sets the mode to "off", the procedure branches to step S520, in which the input pitch data is translated into MIDI data for output. Otherwise, if the quantization mode is "on", the procedure branches to step S510, where the input pitch data is added with a value 0.5, and then the integer portion of the added result is output as a pitch data P. The value "0.5" means the half of semitone (quarter-tone) here. The quantization is actually carried out in this step S510. In step S520, the pitch data is converted into the MIDI data format, and the derived MIDI data is outputted.

Figure 13:
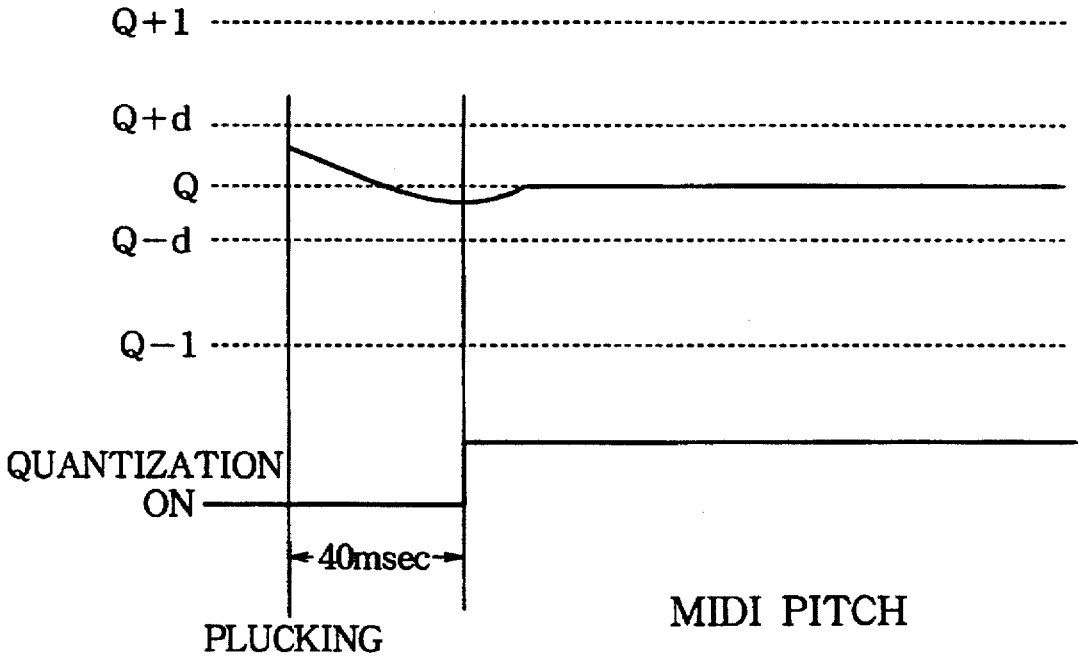
FIG. 13 illustrates the pitch shift subjected to quantization process according to the present invention.

With the conventional quantization, the pitch fall in the "attack" phase just after picking at the note-on event, which is unique in guitars, is eliminated by the quantizing process. This is not desirable from the practical point of view. Thus, in the present invention, the quantizing process is commenced with 40 msec delay after the note-on event to preserve the pitch fall phenomenon. This treatment is illustrated in FIG. 13, wherein the quantizing is executed with some interpolation to smoothly shift to the regular pitch level Q. Otherwise, the pitch might change stepwise at the beginning of the quantization. The resulted final pitch data is converted into MIDI data for output. The preset delay in the quantizing is not limited to 40 msec, and it may be 20 to 100 msec.

Figure 15:
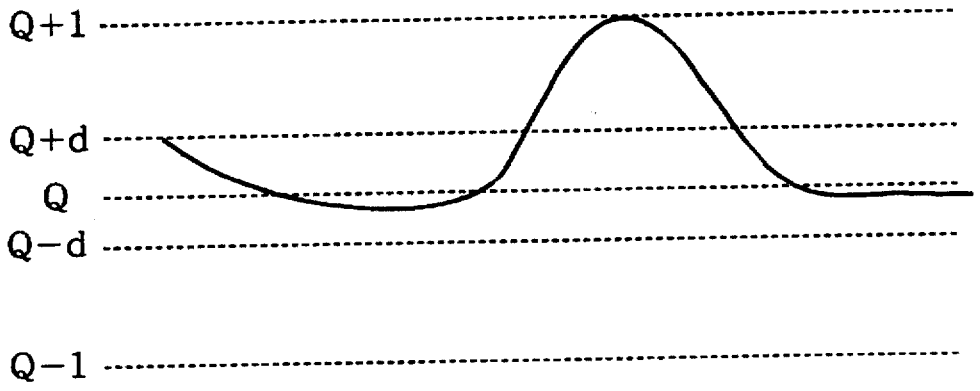
FIG. 15 shows a pitch shift in case that the pitch bending is performed.

The quantization described above refines the tone of the "attack" phase. However, if the quantization is executed even in case that the player intentionally performs bending or choking of the string, the pitch will be changed stepwise due to the quantization and the tone may sound unnatural. Thus, it is expedient to turn off the quantization if the string bending is performed as shown in FIG. 15, wherein the player performs the string bending after the note-on. In this case, the natural pitch-bending tone can be reproduced, but the pitch cannot be corrected in case that the unintentional offset fingering occurs. If the pitch is not stable, it is difficult to play chord.

Figure 16:
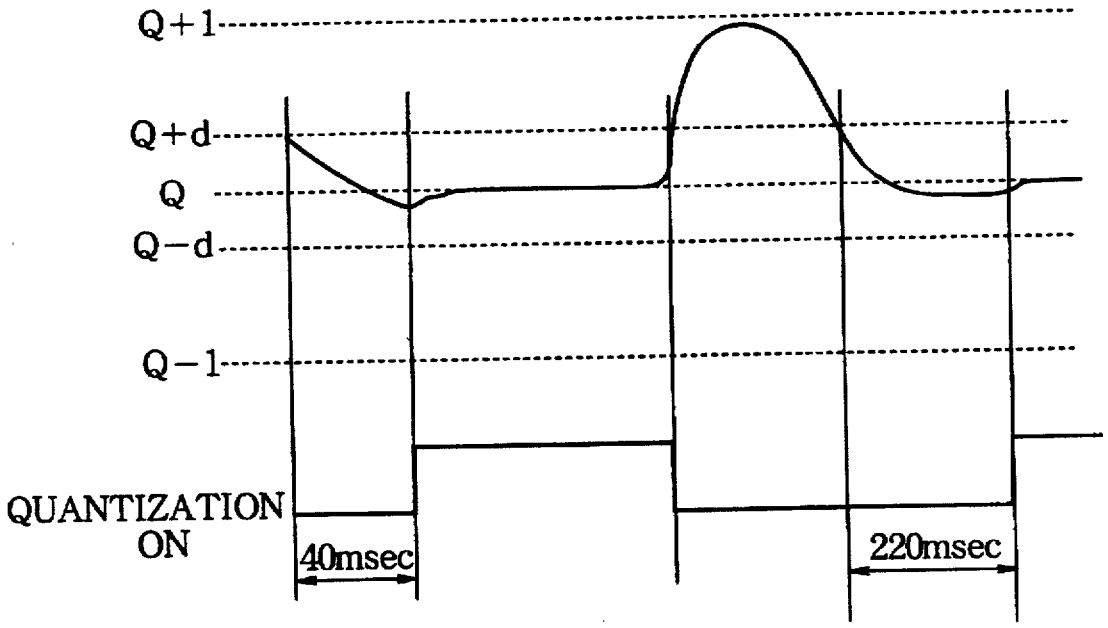
FIG. 16 shows the pitch shift in case that the pitch bending is performed and the quantization process of the present invention is executed.

This problem can be solved as illustrated in FIG. 16. Until the bending is executed, the control is the same as in the case of FIG. 13 wherein the quantization is started about 40 msec after the note-on. The pitch correction by the interpolation is also enabled to tune the pitch to the regular value Q. Further, a pitch deviation over the range Q±d is detected as the intentional pitch-bending in order to turn off the quantization and to output the pitch data as it is. After that, if the pitch returns within the range Q±d, the pitch quantization is turned on after about 220 msec delay. The pitch correction with the interpolation is enabled also in this processing to prevent the pitch data from varying stepwise. Thus, natural pitch data can be derived in the pitch-bending.

The automatic quantization process described above is illustrated in FIG. 17. In the flowchart, the pitch detector outputs the pitch data. The quantization mode is tested if it is "on", "off" or "auto" in step S550. The quantization mode can be set according to the user's preference. If the user sets the mode to "off", the procedure goes forward to step S590, in which the input pitch data is converted into MIDI data for output. Otherwise, if the quantization mode is "on", the procedure goes forward to step S570, wherein the input pitch data is added with a value 0.5, and then the integer portion of the added result is outputted as quantized pitch data P. The value "0.5" corresponds to the half of semitone (quarter-tone) here. The quantization is actually carried out in this step S570. After the smoothening interpolation by an interpolator in step S580, the pitch data is converted into the MIDI data format, and the derived MIDI data is outputted in step S590. If the quantization mode is set in "auto", a pitch-bend detector detects existence of any pitch-bending in step S560. If the pitch returns within the range Q±d, this detection results in "no" so that, the quantization of step S570 is executed. On the other hand, if the pitch changes over the range Q±d, the pitch bending detection results in "yes", and the automatic quantization processing illustrated in FIG. 16 is executed.

Figure 17:
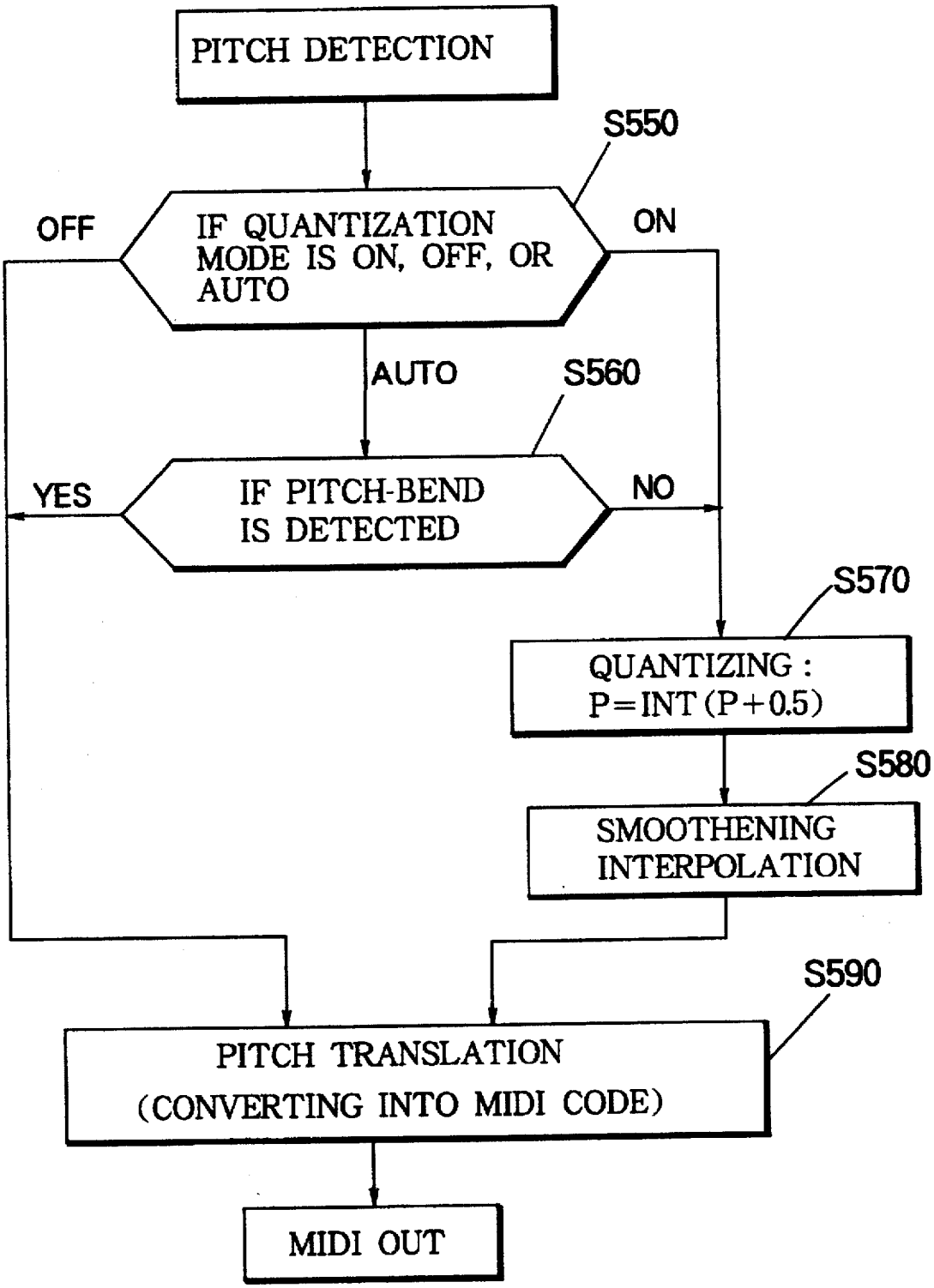
FIG. 17 is a flowchart illustrating the quantization process according to the present invention.
Figure 18:
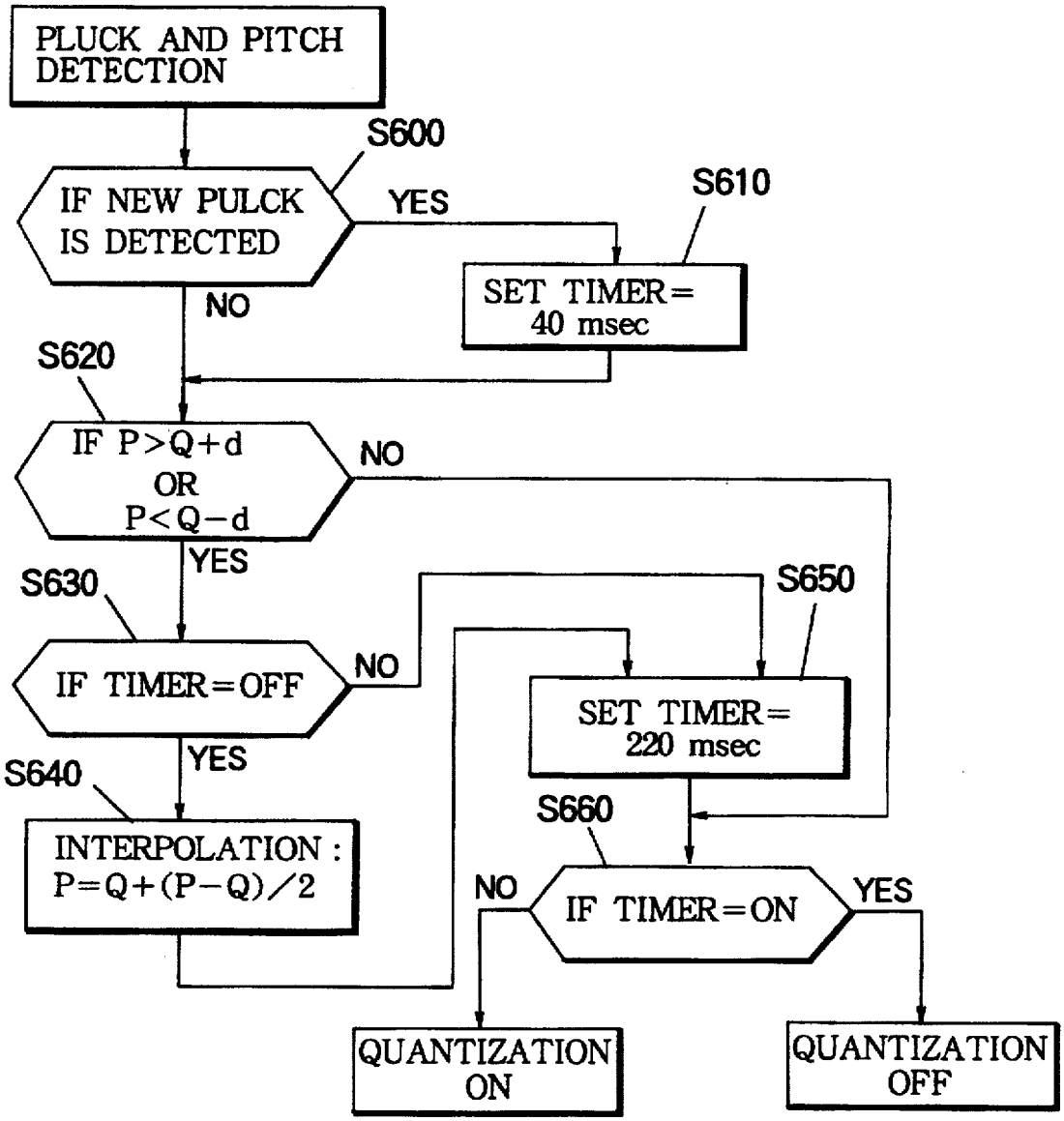
FIG. 18 is a flowchart illustrating the pitch bending detection process according to the present invention.

The pitch-bend detection process in step S560 is illustrated in a flowchart of FIG. 18. Each pluck (note-on) is detected in step S20 of FIG. 9, and the pitch is successively detected by the comparison process in step S60 of FIG. 9. In step S600, it is tested whether the detected pluck is new one or not. If it is new pluck, the procedure goes forward to step S610, wherein 40 msec is set in a timer. The pitch data is compared respectively with levels of Q+d and Q−d in order to detect pitch deviation over the range Q±d in step S620. If the pitch data is within the range Q±d, the test results in "no" to thereby go forward to step S660, wherein turning on or off of the timer is tested. If it is just after the turning on of the timer, the test results in "yes" to disable the quantization process. Thus, during the 40 msec period just after the note-on, the quantizing process is disabled so that the pitch data in the initial attack phase is outputted as it is. After the 40 msec period is elapsed, the timer is turned off. The test in step S660 results in "no" so that the quantizing process is turned on for the pitch quantization. If the player bends or chokes the string at this stage, the pitch data shifts out of the range Q±d. The test of step S620 results in "yes", and then the turning off of the timer is tested in step S630. In this case, the timer is not turned on, so that the test of step S630 results in "yes". Then, the interpolation is executed in step S640. In this smoothening interpolation, correction represented by $$P=Q+(P-Q)/2$$

is executed, if the pitch data P is already quantized to the regular value Q. After the interpolation, the timer is set to 220 msec in step S650. In the following step S660, the timer is detected as being turned on, so that the quantization process is disabled. As described above, if the pitch bending is detected for the pitch data P (step S620), the quantization process is disabled, and the inputted pitch data P is outputted as it is. In the next timing in which the pitch-bend detection process is executed, the test of step S630 results in "no", and thus the timer is set to 220 msec again. Then, if the pitch data is detected to return within the range Q±d in step S620, the test of step S660 results in "no" after the 220 msec count of the timer, so that the quantization is enabled. Therefore, the quantization process shown in FIG. 17 is carried out in step S570, and then the smoothening interpolation process is done in step S580 so that the pitch data converted into the MIDI data is outputted.

With the data processings described above, the accurate pitch data can be derived at high speed. The 40 msec period set to the timer upon note-on in FIG. 18 may be altered to 20 to 100 msec, while the 220 msec period set to the timer upon pitch bending detection can be modified within a range of 100 to 1000 msec. In the description above, the guitar with steel strings is assumed. However, the string may be composed of nylon. The pickup to detect the string vibration may be other types such as a piezo pickup mounted in the bridge of the instrument. The first pitch detector to detect the pitch at high speed may be other types which do not employ the neural network, and the detection result may be outputted just after every vibration signal input. In the explanation above, the pitch of the string vibration is detected. However, the present invention is not limited to that extent, and can be applied to any other pitch detection processes on external voice and external sound. The invention of the pitch detecting method can employ first and second pitch detectors of various types utilizing specific methods such as autocorrelation method and other zero-cross detection methods.

Figure 19:
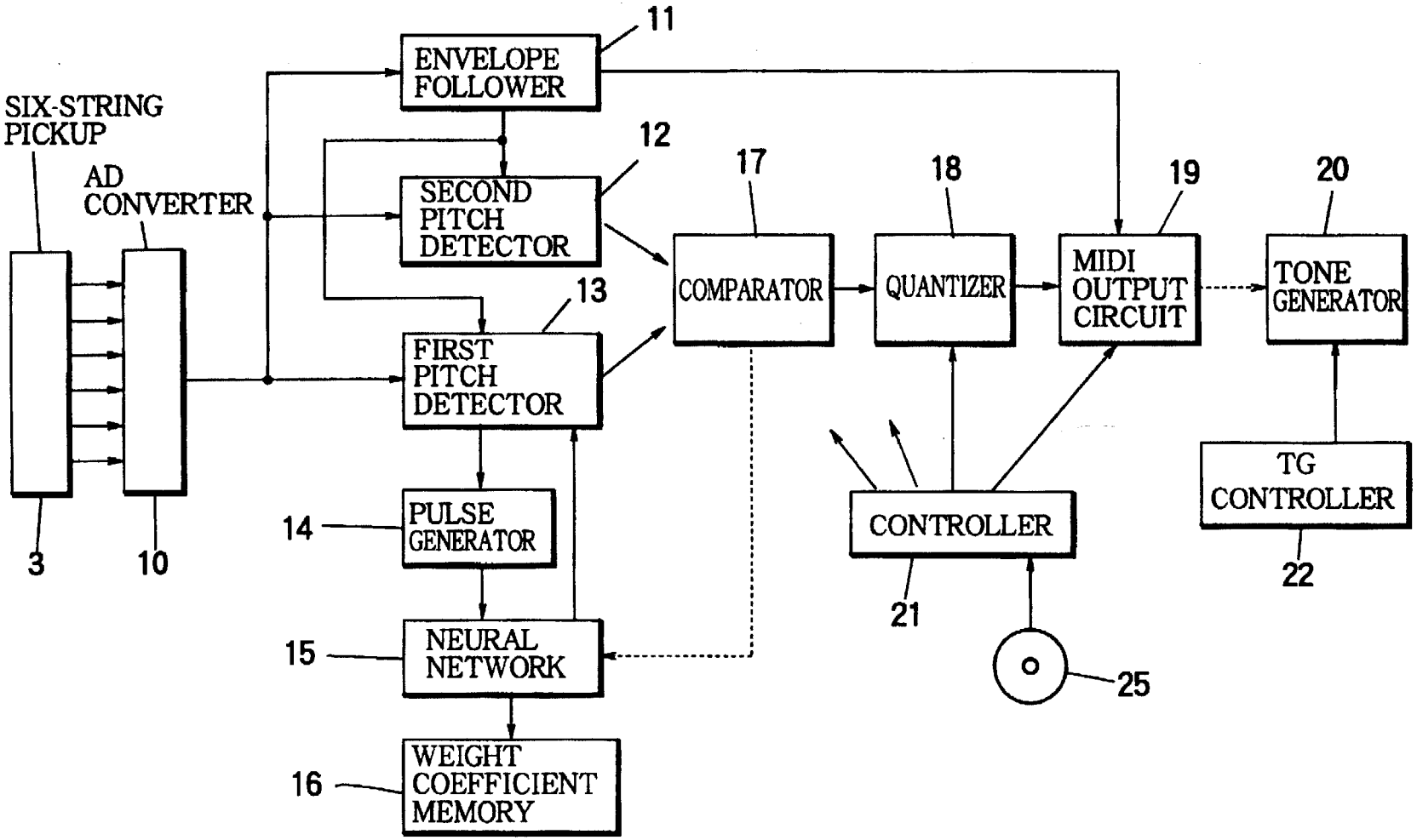
FIG. 19 is a block diagram showing another embodiment of the present invention.

FIG. 19 shows another embodiment of the inventive electronic musical apparatus. This embodiment basically has the same construction as that of the previous embodiment shown in FIG. 3. Therefore, corresponding blocks are denoted by the same reference numerals as those of the previous embodiment to facilitate understanding of this embodiment. The electronic musical apparatus is implemented by a computer system in which all of the functional blocks except for the acoustic instrument such as guitar are integrated altogether in the form of software modules, and are controlled by the controller 21 made of CPU through a system bus (not shown). The system is operated according to an application program loaded into the controller 21 by means of a machine-readable media 25 such as an optical memory disc and a magnetic memory disc.

In the inventive electronic musical apparatus having the acoustic instrument such as the guitar 1 manually operable to commence an acoustic vibration and the tone generator 20 responsive to the acoustic vibration to generate a musical tone having a pitch corresponding to that of the acoustic vibration, the machine-readable media 25 contains instructions for enabling the electronic musical apparatus to perform the following pitch detecting method. The pickup 3 is operated to picking up the acoustic vibration to convert the same into a waveform signal. The first detector 13 is operated according to a fast algorithm for processing the waveform signal so as to responsively produce a first output representative of the pitch of the acoustic vibration. The second detector 12 is operated in parallel to the first detector 13 for processing the same waveform signal according to a slow algorithm so as to stably produce a second output representative of the pitch of the acoustic vibration. The selector in the form of the comparator 17 is operated for selectively feeding one of the first output and the second output to the tone generator 20 so that the first detector 13 and the second detector 12 can cooperate complementarily with each other to ensure responsive and stable detection of the pitch of the acoustic vibration. The first detector 13 is operated for calculating a time interval between two peaks successively contained in the waveform signal according to the fast algorithm so as to roughly detect the pitch, while the second detector 12 is operated for calculating an average of time intervals among three or more peaks successively contained in the waveform signal according to the slow algorithm so as to finely detect the pitch. The selector 17 is operated during an initial period immediately after the acoustic vibration is commenced for selecting the first output, and is operated after the initial period has passed for selecting the second output. The selector 17 is operated for switching frown the first output to the second output when the second detector 12 succeedingly becomes effective to produce the second output after the first detector 13 precedingly becomes effective to produce the first output. The selector 17 is operated when the first, detector 13 fails to produce the first output for selecting the second output in place of the missing first output. The first detector 13 operates the neural network 15 for learning the processing of the waveform signal according to teaching information to improve detection of the pitch, and the selector 17 is operated when the first detector 13 does not operate well for providing the second output as the teaching information to the first detector 13.

The variation detector in the controller 21 connected to either of the first detector 13 and the second detector 12 is operated for detecting variation of the pitch of the acoustic vibration. The quantizer 18 connected between the selector 17 and the tone generator 20 is operated when the detected variation falls within a predetermined range for quantizing the selected one of the first output and the second output to a fixed pitch so as to remove unintentional fluctuation of the acoustic vibration. The controller 21 is operated when the detected variation fails out of the predetermined range for disabling the quantizer 18 to feed the selected one of the first output and the second output as it is to the tone generator 20 to thereby reserve intentional deviation of the acoustic vibration. The quantizer 18 is operated for quantizing the selected one of the first output and the second output to fix the pitch of the musical tone so as to remove fluctuation of the acoustic vibration. The controller 21 is operated during an initial period from the commencing of the acoustic vibration for suppressing the quantizer 18 to feed the selected one of the first output, and the second output as it is to the tone generator 20 so that the musical tone reserves an attack part of the acoustic vibration. Either of the first detector 13 and the second detector 12 is operated for detecting the pitch of the acoustic vibration commenced by plucking a stringed acoustic instrument at a variable plucking point, and for detecting the plucking point according to the waveform signal so that a timbre of the musical tone can be controlled according to the detected plucking point.

In the inventive electronic musical apparatus having the stringed instrument 1 manually operable at a variable plucking point to commence an acoustic vibration and the tone generator 20 responsive to the acoustic vibration to generate a musical tone having a variable timbre depending on the variable plucking point, the machine-readable media 25 contains instructions for enabling the electronic musical apparatus to perform, the following plucking point detecting method. The pickup 3 is operated to pick up the acoustic vibration to convert the same into a waveform signal which contains a pair of peaks distributed at a variable time interval depending on the plucking point. The first pitch detector 13 is operated for processing the waveform signal to measure the time interval between the pair of the peaks so as to detect the plucking point. The controller 21 is operated for controlling the tone generator 20 according to the detected plucking point to change the timbre of the tone generator 20 in response to the plucking point.

In the inventive electronic musical apparatus having the acoustic instrument 1 manually operable to commence an acoustic vibration and the tone generator 20 responsive to the acoustic vibration to generate a musical tone having a pitch corresponding to that of the acoustic vibration, the machine-readable media 25 contains instructions for enabling the electronic musical apparatus to perform the following pitch detecting method. The pickup 3 is operated for picking up the acoustic vibration to convert the same into a waveform signal. The detector 13 is operated for processing the waveform signal to successively detect a pitch of the acoustic vibration. The quantizer 18 is operated for successively quantizing the detected pitch and feeding the quantized pitch to the tone generator 20 so that the tone generator 20 can generate the musical tone having the successively quantized pitch. The controller 21 is operated depending on a specific condition of the acoustic vibration for temporarily disabling the quantizer 18 so as to feed the detected pitch as it is to the tone generator 20 so that the generated musical tone temporarily maintains the detected pitch which reflects the specific condition of the acoustic vibration. The controller 21 is operated for detecting variation of the successively detected pitch. The controller 21 is operated when the detected variation falls within a predetermined range under a normal condition for enabling the quantizer 18, and is operated when the detected variation falls out of the predetermined range under a specific condition for disabling the quantizer 18. The controller 21 is operated during an initial period from the commencement of the acoustic vibration for disabling the quantizer 18, and is operated after the initial period has passed for enabling the quantizer 18.

As described in the foregoing, according to the present invention, it is possible to detect the playing position where the string is picked by measuring the time interval between intermittent vibration pulses propagated in the string. Further, according to the present invention, the first pitch detector operates to detect the pitch of the input vibration signal at high speed, and the second pitch detector operates to detect the pitch of the same input vibration signal with a pitch detection algorithm different from that of the first pitch detector. These first and second pitch detectors can cooperate complementarily with each other. Thus an accurate pitch can be detected at high speed. Further, according to the present invention, the pitch quantizer is controlled to stop the pitch quantization in case that the pitch bending is detected. Therefore, the player performs the pitch bending so that the pitch effected by the pitch bending can be outputted as it is. Further, the accurate pitch can be derived even when the fingered position of the string is moved off the regular position.

What is claimed is:

1. In an electronic musical apparatus having an acoustic instrument manually operable to commence an acoustic vibration and a tone generator responsive to the acoustic vibration to generate a musical tone having a pitch corresponding to that of the acoustic vibration, a pitch detecting device comprising:

pickup means for picking up the acoustic vibration to convert the same into a waveform signal;

first detector means operative according to a fast algorithm for processing the waveform signal so as to responsively produce a first output representative of the pitch of the acoustic vibration;

second detector means operative in parallel to the first detector means for processing the same waveform signal according to a slow algorithm so as to stably produce a second output representative of the pitch of the acoustic vibration; and selector means for selectively feeding one of the first output and the second output to the tone generator so that the first detector means and the second detector means can cooperate complementarily with each other to ensure responsive and stable detection of the pitch of the acoustic vibration.

2. The pitch detecting device according to claim 1, wherein the first detector means comprises means for calculating a time interval between two peaks successively contained in the waveform signal according to the fast algorithm so as to roughly detect the pitch, while the second detector means comprises means for calculating an average of time intervals among three or more peaks successively contained in the waveform signal according to the slow algorithm so as to finely detect the pitch.

3. The pitch detecting device according to claim 1, wherein the selector means comprises means operative during an initial period immediately after the acoustic vibration is commenced for selecting the first output, and being operative after the initial period has passed for selecting the second output.

4. The pitch detecting device according to claim 1, wherein the selector means comprises means for switching from the first output to the second output when the second detector means succeedingly becomes effective to produce the second output, after the first, detector means precedingly becomes effective to produce the first output.

5. The pitch detecting device according to claim 1, wherein the selector means comprises means operative when the first detector means fails to produce the first output for selecting the second output in place of the missing first output.

6. The pitch detecting device according to claim 1, wherein the first detector means includes a neural network for learning the processing of the waveform signal according to teaching information to improve detection of the pitch, and the selector means includes means operative when the first detector means does not operate well for providing the second output as the teaching information to the first detector means.

7. The pitch detecting device according to claim 1, including variation detector means connected to either of the first detector means and the second detector means for detecting variation of the pitch of the acoustic vibration, quantizer means connected between the selector means and the tone generator and being operative when the detected variation falls within a predetermined range for quantizing the selected one of the first output and the second output to a fixed pitch so as to remove unintentional fluctuation of the acoustic vibration, and controller means operative when the detected variation falls out of the predetermined range for disabling the quantizer means to feed the selected one of the first output and the second output as it is to the tone generator to thereby reserve intentional deviation of the acoustic vibration.

8. The pitch detecting device according to claim 1, including quantizer means connected between the selector means and the tone generator for quantizing the selected one of the first output and the second output to fix the pitch of the musical tone so as to remove fluctuation of the acoustic vibration, and controller means operative during an initial period from the commencing of the acoustic vibration for suppressing the quantizer means to feed the selected one of the first output and the second output as it is to the tone generator so that the musical tone reserves an attack part of the acoustic vibration.

9. The pitch detecting device according to claim 1, wherein either of the first detector means and the second detector means includes means for detecting the pitch of the acoustic vibration commenced by plucking a stringed acoustic instrument at a variable plucking point, and means for detecting the plucking point according to the waveform signal so that a timbre of the musical tone can be controlled according to the detected plucking point.

10. In an electronic musical apparatus having a stringed instrument manually operable at a variable plucking point to commence an acoustic vibration and a tone generator responsive to the acoustic vibration to generate a musical tone having a variable timbre depending on the variable plucking point, a plucking point detecting device comprising:

pickup means for picking up the acoustic vibration to convert the same into a waveform signal which contains a pair of peaks distributed at a variable time interval depending on the plucking point;

detector means for processing the waveform signal to measure the time interval between the pair of the peaks so as to detect the plucking point; and controller means for controlling the tone generator according to the detected plucking point to change the timbre of the tone generator in response to the plucking point.

11. In an electronic musical apparatus having an acoustic instrument manually operable to commence an acoustic vibration and a tone generator responsive to the acoustic vibration to generate a musical tone having a pitch corresponding to that of the acoustic vibration, a pitch detecting device comprising:

pickup means for picking up the acoustic vibration to convert the same into a waveform signal;

detector means for processing the waveform signal to successively detect a pitch of the acoustic vibration;

quantizer means for successively quantizing the detected pitch and feeding the quantized pitch to the tone generator so that the tone generator can generate the musical tone having the successively quantized pitch; and controller means operative depending on a specific condition of the acoustic vibration for temporarily disabling the quantizer means so as to feed the detected pitch as it is to the tone generator so that the generated musical tone temporarily maintains the detected pitch which reflects the specific condition of the acoustic vibration.

12. The pitch detecting device according to claim 11, wherein the controller means comprises means for detecting variation of the successively detected pitch, and means operative when the detected variation falls within a predetermined range under a normal condition for enabling the quantizer means and being operative when the detected variation falls out of the predetermined range under a specific condition for disabling the quantizer means.

13. The pitch detecting device according to claim 11, wherein the controller means comprises means operative during an initial period from the commencement of the acoustic vibration for disabling the quantizer means, and being operative after the initial period has passed for enabling the quantizer means.

14. In an electronic musical apparatus having an acoustic instrument manually operable to commence an acoustic vibration and a tone generator responsive to the acoustic vibration to generate a musical tone having a pitch corresponding to that of the acoustic vibration, a pitch detecting method comprising the steps of:

picking up the acoustic vibration to convert the same into a waveform signal;

operating a first detector according to a fast algorithm for processing the waveform signal so as to responsively produce a first output representative of the pitch of the acoustic vibration;

operating a second detector in parallel to the first detector for processing the same waveform signal according to a slow algorithm so as to stably produce a second output representative of the pitch of the acoustic vibration; and operating a selector for selectively feeding one of the first output and the second output to the tone generator so that the first detector and the second detector can cooperate complementarily with each other to ensure responsive and stable detection of the pitch of the acoustic vibration.

15. The pitch detecting method according to claim 14, wherein the operating step of the first detector comprises calculating a time interval between two peaks successively contained in the waveform signal according to the fast algorithm so as to roughly detect the pitch, while the operating step of the second detector comprises calculating an average of time intervals among three or more peaks successively contained in the waveform signal according to the slow algorithm so as to finely detect the pitch.

16. The pitch detecting method according to claim 14, wherein the operating step of the selector comprises operating the selector during an initial period immediately after the acoustic vibration is commenced for selecting the first output, and operating the selector after the initial period has passed for selecting the second output.

17. The pitch detecting method according to claim 14, wherein the operating step of the selector comprises switching from the first output to the second output when the second detector succeedingly becomes effective to produce the second output after the first detector precedingly becomes effective to produce the first output.

18. The pitch detecting method according to claim 14, wherein the operating step of the selector comprises operating the selector when the first detector fails to produce the first output for selecting the second output in place of the missing first output.

19. The pitch detecting method according to claim 14, wherein the operating step of the first detector includes operating a neural network within the first detector for learning the processing of the waveform signal according to teaching information to improve detection of the pitch, and the operating step of the selector comprises operating the selector when the first detector does not operate well for providing the second output as the teaching information to the first detector.

20. The pitch detecting method according to claim 14, including steps of operating a variation detector connected to either of the first detector and the second detector for detecting variation of the pitch of the acoustic vibration, operating a quantizer connected between the selector and the tone generator when the detected variation falls within a predetermined range for quantizing the selected one of the first output and the second output to a fixed pitch so as to remove unintentional fluctuation of the acoustic vibration, and operating a controller when the detected variation falls out of the predetermined range for disabling the quantizer to feed the selected one of the first output and the second output as it is to the tone generator to thereby reserve intentional deviation of the acoustic vibration.

21. The pitch detecting method according to claim 14, including steps of operating a quantizer connected between the selector and the tone generator for quantizing the selected one of the first output and the second output to fix the pitch of the musical tone so as to remove fluctuation of the acoustic vibration, and operating a controller during an initial period from the commencing of the acoustic vibration for suppressing the quantizer to feed the selected one of the first output and the second output as it is to the tone generator so that the musical tone reserves an attack part of the acoustic vibration.

22. The pitch detecting method according to claim 14, wherein either of the operating steps of the first detector and the second detector includes detecting the pitch of the acoustic vibration commenced by plucking a stringed acoustic instrument at a variable plucking point, and detecting the plucking point according to the waveform signal so that a timbre of the musical tone can be controlled according to the detected plucking point.

23. In an electronic musical apparatus having a stringed instrument manually operable at a variable plucking point to commence an acoustic vibration and a tone generator responsive to the acoustic vibration to generate a musical tone having a variable timbre depending on the variable plucking point, a plucking point detecting method comprising the steps of:

picking up the acoustic vibration to convert the same into a waveform signal which contains a pair of peaks distributed at a variable time interval depending on the plucking point;

processing the waveform signal to measure the time interval between the pair of the peaks so as to detect the plucking point; and controlling the tone generator according to the detected plucking point to change the timbre of the tone generator in response to the plucking point.

24. In an electronic musical apparatus having an acoustic instrument manually operable to commence an acoustic vibration and a tone generator responsive to the acoustic vibration to generate a musical tone having a pitch corresponding to that of the acoustic vibration, a pitch detecting method comprising the steps of:

picking up the acoustic vibration to convert the same into a waveform signal;

processing the waveform signal to successively detect a pitch of the acoustic vibration;

operating a quantizer for successively quantizing the detected pitch and feeding the quantized pitch to the tone generator so that the tone generator can generate the musical tone having the successively quantized pitch; and operating a controller dependently on a specific condition of the acoustic vibration for temporarily disabling the quantizer so as to feed the detected pitch as it is to the tone generator so that the generated musical tone temporarily maintains the detected pitch which reflects the specific condition of the acoustic vibration.

25. The pitch detecting method according to claim 24, wherein the operating step of the controller comprises detecting variation of the successively detected pitch, operating the controller when the detected variation falls within a predetermined range under a normal condition for enabling the quantizer, and operating the controller when the detected variation falls out of the predetermined range under a specific condition for disabling the quantizer.

26. The pitch detecting method according to claim 24, wherein the operating step of the controller comprises operating the controller during an initial period from the commencement of the acoustic vibration for disabling the quantizer, and operating the controller after the initial period has passed for enabling the quantizer.

27. A machine-readable media for use in an electronic musical apparatus having an acoustic instrument manually operable to commence an acoustic vibration and a tone generator responsive to the acoustic vibration to generate a musical tone having a pitch corresponding to that of the acoustic vibration, the machine-readable media containing instructions executable by the electronic musical apparatus for causing the electronic musical apparatus to perform a pitch detecting operation including the steps of:

picking up the acoustic vibration to convert the same into a waveform signal;

operating a first detector according to a fast algorithm for processing the waveform signal so as to responsively produce a first output representative of the pitch of the acoustic vibration;

operating a second detector in parallel to the first detector for processing the same waveform signal according to a slow algorithm so as to stably produce a second output representative of the pitch of the acoustic vibration; and operating a selector for selectively feeding one of the first output and the second output to the tone generator so that the first detector and the second detector can cooperate complementarily with each other to ensure responsive and stable detection of the pitch of the acoustic vibration.

28. The machine-readable media according to claim 27, wherein the media contains instructions to control the pitch detecting operation such that the operating of the first detector comprises calculating a time interval between two peaks successively contained in the waveform signal according to the fast algorithm so as to roughly detect the pitch, while the operating of the second detector comprises calculating an average of time intervals among three or more peaks successively contained in the waveform signal according to the slow algorithm so as to finely detect the pitch.

29. The machine-readable media according to claim 27, wherein the media contains instructions to control the pitch detecting operation such that the operation of the selector comprises operating the selector during an initial period immediately after the acoustic vibration is commenced for selecting the first output, and operating the selector after the initial period has passed for selecting the second output.

30. The machine-readable media according to claim 27, wherein the media contains instructions to control the pitch detecting operation such that the operation of the selector comprises switching from the first output to the second output when the second detector becomes effective to produce the second output after the first detector becomes effective to produce the first output.

31. The machine-readable media according to claim 27, wherein the media contains instructions to control the pitch detecting operation such that the operating of the selector comprises operating the selector when the first detector fails to produce the first output for selecting the second output in place of the missing first output.

32. The machine-readable media according to claim 27, wherein the media contains instructions to control the pitch detecting operation such that the operation of the first detector includes operating a neural network within the first detector for learning the processing of the waveform signal according to teaching information to improve detection of the pitch, and the operating of the selector comprises operating the selector when the first detector does not operate well for providing the second output as the teaching information of the first detector.

33. The machine-readable media according to claim 27, wherein the media contains instructions to control the pitch detecting operation to include operating a variation detector connected to either of the first detector and the second detector for detecting variation of the pitch of the acoustic vibration, operating a quantizer connected between the selector and the tone generator when the detected variation falls within a predetermined range for quantizing the selected one of the first output and the second output to a fixed pitch so as to remove unintentional fluctuation of the acoustic vibration, and operating a controller when the detected variation falls out of the predetermined range for disabling the quantizer to feed the selected one of the first output and the second output as it is to the tone generator to thereby reserve intentional deviation of the acoustic vibration.

34. The machine-readable media according to claim 27, wherein the media contains instructions to control the pitch detecting operation to include operating a quantizer connected between the selector and the tone generator for quantizing the selected one of the first output and the second output to fix the pitch of the musical tone so as to remove fluctuation of the acoustic vibration, and operating a controller during an initial period from the commencing of the acoustic vibration for suppressing the quantizer to feed the selected one of the first output and the second output as it is to the tone generator so that the musical tone reserves an attack part of the acoustic vibration.

35. The machine-readable media according to claim 27 wherein either of the operating steps of the first detector and the second detector includes detecting the pitch of the acoustic vibration commenced by plucking a stringed acoustic instrument at a variable plucking point, and detecting the plucking point according to the waveform signal so that a timbre of the musical tone can be controlled according to the detected plucking point.

36. A machine-readable media for use in an electronic musical apparatus having a stringed instrument manually operable at a variable plucking point to commence an acoustic vibration and a tone generator responsive to the acoustic vibration to generate a musical tone having a variable timbre depending on the variable plucking point, the machine-readable media containing instructions executable by the electronic musical apparatus for causing the electronic musical apparatus to perform a plucking point detecting operation including the steps of:

picking up the acoustic vibration to convert the same into a waveform signal which contains a pair of peaks distributed at a variable time interval depending on the plucking point;

processing the waveform signal to measure the time interval between the pair of the peaks so as to detect the plucking point; and controlling the tone generator according to the detected plucking point to change the timbre of the tone generator in response to the plucking point.

37. A machine-readable media for use in an electronic musical apparatus having an acoustic instrument manually operable to commence an acoustic vibration and a tone generator responsive to the acoustic vibration to generate a musical tone having a pitch corresponding to that of the acoustic vibration, the machine-readable media containing instructions executable by the electronic musical apparatus for causing the electronic musical apparatus to perform a pitch detecting operation including the steps of:

picking up the acoustic vibration to convert the same into a waveform signal;

processing the waveform signal to successively detect a pitch of the acoustic vibration;

operating a quantizer for successively quantizing the detected pitch and feeding the quantized pitch to the tone generator so that the tone generator can generate the musical tone having the successively quantized pitch; and operating a controller dependently on a specific condition of the acoustic vibration for temporarily disabling the quantizer so as to feed the detected pitch as it is to the tone generator so that the generated musical tone temporarily maintains the detected pitch which reflects the specific condition of the acoustic vibration.

38. The machine-readable media according to claim 37, wherein the step of operating of the controller comprises detecting variation of the successively detected pitch, operating the controller when the detected variation falls within a predetermined range under a normal condition for enabling the quantizer, and operating the controller when the detected variation falls out of the predetermined range under a specific condition for disabling the quantizer.

39. The machine-readable media according to claim 37, wherein the operating step of the controller comprises operating the controller during an initial period from the commencement of the acoustic vibration for disabling the quantizer, and operating the controller after the initial period has passed for enabling the quantizer.

* * * * *